US010065429B2

(12) United States Patent
Yamanobe

(10) Patent No.: US 10,065,429 B2
(45) Date of Patent: Sep. 4, 2018

(54) DEVICE AND METHOD OF DETERMINING AMOUNT OF TRANSPARENT LIQUID TO BE JETTED, AN IMAGE FORMING APPARATUS, AND AN IMAGE FORMING METHOD

(71) Applicant: FUJIFILM Corporation, Tokyo (JP)

(72) Inventor: Jun Yamanobe, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/704,602

(22) Filed: Sep. 14, 2017

(65) Prior Publication Data

US 2018/0001657 A1 Jan. 4, 2018

Related U.S. Application Data

(63) Continuation of application No. PCT/JP2016/057599, filed on Mar. 10, 2016.

(30) Foreign Application Priority Data

Mar. 18, 2015 (JP) ..... 2015-054298

(51) Int. Cl.
*B41J 29/393* (2006.01)
*B41J 2/21* (2006.01)
*B41J 2/045* (2006.01)

(52) U.S. Cl.
CPC ..... *B41J 2/2114* (2013.01); *B41J 2/04558* (2013.01)

(58) Field of Classification Search
CPC ..... B41J 2/2114; B41J 2/04558
See application file for complete search history.

(56) References Cited

U.S. PATENT DOCUMENTS

2004/0090475 A1 5/2004 Ioka et al.
2014/0253621 A1* 9/2014 Sakurada ..... B41J 2/2132 347/15
2016/0347081 A1* 12/2016 Fukasawa ..... B41J 2/16579

FOREIGN PATENT DOCUMENTS

JP 2003-285518 A 10/2003
JP 2010-201639 A 9/2010
(Continued)

OTHER PUBLICATIONS

International Preliminary Report on Patentability and Written Opinion of the International Searching Authority (Forms PCT/IB/326, PCT/IB/373 and PCT/ISA/237) for International Application No. PCT/JP2016/057599, dated Sep. 28, 2017, with an English translation of the Written Opinion.
(Continued)

*Primary Examiner* — Julian Huffman
(74) *Attorney, Agent, or Firm* — Birch, Stewart, Kolasch & Birch, LLP

(57) ABSTRACT

Test patterns are printed by ink jet means for jetting ink containing a color material and transparent liquid jet means for jetting transparent liquid. In the test patterns, ink and transparent liquid are applied to different regions on the same medium and ink application regions and transparent liquid application regions are arranged adjacent to each other. A device for determining the amount of transparent liquid to be jetted includes information acquisition means for acquiring information representing the amount of medium deformation of a medium on which the test patterns are printed, and information processing means for determining the amount of transparent liquid to be jetted by the transparent liquid jet means for jetting the transparent liquid, from the information representing the amount of medium deformation acquired by the information acquisition means.

11 Claims, 23 Drawing Sheets

(56) References Cited

FOREIGN PATENT DOCUMENTS

| | | | |
|---|---|---|---|
| JP | 2011-126123 | A | 6/2011 |
| JP | 2011-161822 | A | 8/2011 |
| JP | 2012-206337 | A | 10/2012 |
| JP | 2013-111922 | A | 6/2013 |
| JP | 2013-146922 | A | 8/2013 |
| JP | 2013-159100 | A | 8/2013 |

OTHER PUBLICATIONS

International Search Report (Form PCT/ISA/210) for International Application No. PCT/JP2016/057599, dated May 31, 2016, with an English translation.

Japanese Decision to Grant issued in Japanese Application No. 2015-054298 dated Dec. 14, 2017, together with an English translation.

* cited by examiner

DEVICE AND METHOD OF DETERMINING AMOUNT OF TRANSPARENT LIQUID TO BE JETTED, AN IMAGE FORMING APPARATUS, AND AN IMAGE FORMING METHOD

CROSS-REFERENCE TO RELATED APPLICATIONS

The present application is a Continuation of PCT International Application No. PCT/JP2016/057599 filed on Mar. 10, 2016 claiming priority under 35 U.S.C § 119(a) to Japanese Patent Application No. 2015-054298 filed on Mar. 18, 2015. Each of the above applications is hereby expressly incorporated by reference, in their entirety, into the present application.

BACKGROUND OF THE INVENTION

1. Field of the Invention

The present invention relates to a device and method of determining the amount of transparent liquid to be jetted, an image forming apparatus, and an image forming method, and more particularly, to a technique for determining the amount of transparent liquid to be jetted in a case in which transparent liquid is jetted from a liquid jet unit and an image forming technique using transparent liquid.

2. Description of the Related Art

There is a problem that the sheet to which ink has been applied is deformed in a case in which an image is formed on a sheet by an ink jet method, particularly, in a case in which aqueous ink of which the main solvent is water is applied to a sheet to form an image. The deformation of the sheet is caused by a difference in the amount of water acting on the sheet between a printed region to which ink is applied and an unprinted region to which ink is not applied.

A technique for eliminating or reducing a difference in the amount of water between the printed region and the unprinted region by jetting colorless and transparent liquid to the unprinted region is proposed to suppress the deformation of the sheet (for example, see JP2011-161822A). The colorless and transparent liquid is called "transparent liquid".

SUMMARY OF THE INVENTION

The transparent liquid, which is used to suppress the deformation of the sheet, should be applied to a region to which ink is not applied to the sheet too much (low-image-density region) and the unprinted region, that is, a region in which an image is not formed. Hereinafter, the low-image-density region to which the transparent liquid needs to be applied and the unprinted region are represented by the word of an "unprinted region". It is difficult to selectively apply transparent liquid to an unprinted region in a liquid application method of uniformly applying liquid to a sheet as in application using a roller. Accordingly, it is preferable that a liquid jet unit, which easily controls the selective application of transparent liquid to an unprinted region, is used as in an ink jet method as means for applying transparent liquid.

Further, the main object of the transparent liquid, which is used to suppress the deformation of a sheet, is just to reduce the deformation of the sheet. Accordingly, it is preferable that the appearance of the unprinted region to which transparent liquid has been applied is not almost changed, that is, a visual action on the appearance of a region to which transparent liquid has been applied is not substantially changed according to the presence or absence of the transparent liquid.

The deviation of the amount of actually jetted liquid from a prescribed target value assumed in advance occurs in the liquid jet unit. For example, since the jet properties of the respective nozzles vary or jetting failures occur in some nozzles in the case of an ink jet head including a plurality of nozzles, the amount of liquid to be jetted may deviate from the prescribed target value assumed in advance. In this case, the amount of liquid to be jetted from the liquid jet unit needs to be corrected. The description of "correcting" the amount of liquid to be jetted includes the concept of the adjustment of the amount of liquid to be jetted, processing or control for rationalizing the amount of liquid to be jetted, and the like.

In the case of usual ink containing a color material, that is, colored ink, a method including a step of printing a predetermined patch as a test, a step of measuring the physical quantity, such as optical density, of the printed patch, and a step of correcting the amount of liquid to be jetted on the basis of the result of the measurement is employed to correct the amount of ink to be jetted.

However, since it is difficult to measure the physical quantity, such as optical density, of substantially colorless and transparent liquid, the same correction method as that for the ink containing a color material cannot be employed in the case of the substantially colorless and transparent liquid.

The invention has been made in consideration of the above-mentioned circumstances, and an object of the invention is to provide a device and method of determining the amount of transparent liquid to be jetted, an image forming apparatus, and an image forming method that can correct the amount of transparent liquid to be jetted from a liquid jet unit by a simple method.

The following aspects of the invention are provided to achieve the object.

A device for determining the amount of transparent liquid to be jetted according to a first aspect comprises: information acquisition means for acquiring information representing the amount of medium deformation of a test pattern which is printed by ink jet means for jetting ink containing a color material and transparent liquid jet means for jetting transparent liquid and in which the ink and the transparent liquid are applied to different regions on the same medium and ink application regions to which the ink is applied and transparent liquid application regions to which the transparent liquid is applied are arranged adjacent to each other; and information processing means for determining the amount of transparent liquid to be jetted by the transparent liquid jet means for jetting the transparent liquid, from the information representing the amount of medium deformation acquired by the information acquisition means.

The amount of medium deformation of a test printed article on which the test pattern is printed reflects the excess and deficiency of the amount of transparent liquid to be jetted. According to the device for determining the amount of transparent liquid to be jetted of the first aspect, it is possible to grasp the degree of the amount of transparent liquid to be jetted from the information representing the amount of medium deformation of the test pattern. Accordingly, the amount of transparent liquid to be jetted can be simply adjusted.

An aspect in which the ink application region and the transparent liquid application region are adjacent to each other is not limited to an aspect in which the ink application region and the transparent liquid application region are in contact with each other, and a small gap may be formed between the ink application region and the transparent liquid application region.

According to a second aspect, in the device for determining the amount of transparent liquid to be jetted according to the first aspect, the transparent liquid jet means may comprise a nozzle array in which a plurality of nozzles are arranged at different positions in a first direction, the test pattern may include the ink application regions having the shape of a stripe extending in a second direction, which is a direction perpendicular to the first direction of the medium, and the transparent liquid application regions that has the shape of a stripe extending in the second direction, and the transparent liquid application regions and the ink application regions may be arranged adjacent to each other in the first direction.

According to the second aspect, a signal-to-noise ratio (S/N ratio) at the time of measurement of the amount of medium deformation can be increased. Accordingly, the results of the measurement are stable.

According to a third aspect, in the device for determining the amount of transparent liquid to be jetted according to the first or second aspect, each of the ink jet means and the transparent liquid jet means may include a plurality of head modules for jetting liquid droplets by an ink jet method, and each of the stripes of the plurality of transparent liquid application regions to which the transparent liquid is applied may be formed by the jet of the transparent liquid from N head modules of the transparent liquid jet means in a case in which N is set to an integer equal to or larger than 1.

According to the third aspect, it is possible to adjust a variation in the amount of transparent liquid to be jetted from the respective head modules of the transparent liquid jet means.

According to a fourth aspect, in the device for determining the amount of transparent liquid to be jetted according to any one of the first to third aspects, the test pattern may include the plurality of ink application regions and the transparent liquid application regions may be disposed between the plurality of ink application regions.

According to the fourth aspect, a signal-to-noise ratio at the time of measurement of the amount of medium deformation can be increased.

According to a fifth aspect, in the device for determining the amount of transparent liquid to be jetted according to the fourth aspect, the amount of transparent liquid to be jetted to each of the plurality of transparent liquid application regions may be determined on the basis of the amount of medium deformation of the transparent liquid application region corresponding to a region as a target and the amount of medium deformation of the ink application regions that are positioned on both sides of the region as a target so as to be adjacent to the region, the information processing means may reduce the amount of transparent liquid to be jetted to the region as a target as much as the amount of medium deformation of the transparent liquid application region corresponding to the region as a target is large, and the information processing means may increase the amount of transparent liquid to be jetted to the region as a target as much as the amount of medium deformation of the ink application regions, which are positioned on both sides of the region as a target so as to be adjacent to the region, is large.

According to the fifth aspect, an algorithm, which determines the amount of transparent liquid to be jetted, can be made simple. Further, the number of test printed articles, which are printed articles on which the test patterns are printed, can be reduced.

According to a sixth aspect, the device for determining the amount of transparent liquid to be jetted according to any one of the first to fifth aspects may further comprise deformation measurement means for measuring the amount of deformation of a test printed article on which the test pattern is printed, and the information acquisition means may acquire information representing the amount of medium deformation from the amount of deformation measured by the deformation measurement means.

The acquisition of the information, which represents the amount of medium deformation, can be automated using the deformation measurement means. Since the amount of medium deformation is automatically measured, a variation in measurement data is reduced and a load on an operator is reduced.

According to a seventh aspect, in the device for determining the amount of transparent liquid to be jetted according to any one of the first to sixth aspects, the information processing means may include correction value calculating means for obtaining a correction value, which is used to correct the amount of transparent liquid to be jetted, from the information representing the amount of medium deformation.

According to an eighth aspect, in the device for determining the amount of transparent liquid to be jetted according to any one of the first to seventh aspects, a plurality of times of test printing in which the amount of transparent liquid to be jetted to the transparent liquid application regions of the test pattern varies may be performed, the information acquisition means may acquire information representing the amount of medium deformation of each of the plurality of times of test printing, and the information processing means may determine a value of the amount of transparent liquid to be jetted, which is obtained when the amount of medium deformation is minimum, as a value of the amount of transparent liquid to be jetted, on the basis of information representing the amount of medium deformation obtained from each of the plurality of times of test printing.

According to the eighth aspect, the convergence of the results of the algorithm, which determines the amount of transparent liquid to be jetted, can be made quick.

According to a ninth aspect, in the device for determining the amount of transparent liquid to be jetted according to any one of the first to eighth aspects, the information processing means may include transparent-liquid-jet-amount-determination table changing means for changing a transparent-liquid-jet-amount-determination table in which a relationship between the amount of ink per unit region and the amount of transparent liquid to be jetted is prescribed, by using the determined value of the amount of transparent liquid to be jetted.

A method of determining the amount of transparent liquid to be jetted according to a tenth aspect comprises: an information acquisition step of acquiring information representing the amount of medium deformation of a test pattern which is printed by ink jet means for jetting ink containing a color material and transparent liquid jet means for jetting transparent liquid and in which the ink and the transparent liquid are applied to different regions on the same medium and ink application regions to which the ink is applied and transparent liquid application regions to which the transparent liquid is applied are arranged adjacent to each other; and an information processing step of determining the amount of transparent liquid to be jetted by the transparent liquid jet means for jetting the transparent liquid, from the information representing the amount of medium deformation acquired by the information acquisition step.

According to an eleventh aspect, the method of determining the amount of transparent liquid to be jetted according to the tenth aspect may further comprise a test pattern printing step of printing the test pattern by the ink jet means and the transparent liquid jet means.

In the method of determining the amount of transparent liquid to be jetted according to the tenth or eleventh aspect, the same matters as the matters specified in the second to ninth aspects can be appropriately combined with each other. In this case, means for serving processing or a function, which is specified in the device for determining the amount of transparent liquid to be jetted, can be grasped as elements of "steps" of processing or an operation corresponding thereto.

An image forming apparatus according to a twelfth aspect comprises: ink jet means for jetting ink containing a color material; transparent liquid jet means for jetting transparent liquid; test pattern printing control means for outputting a test pattern in which the ink and the transparent liquid are applied to different regions on the same medium and ink application regions to which the ink is applied and transparent liquid application regions to which the transparent liquid is applied are arranged adjacent to each other, by controlling the ink jet means and the transparent liquid jet means; information acquisition means for acquiring information representing the amount of medium deformation of the test pattern; and information processing means for determining the amount of transparent liquid to be jetted, from the information representing the amount of medium deformation acquired by the information acquisition means.

According to the twelfth aspect, the amount of transparent liquid to be applied to a medium can be appropriately adjusted. Accordingly, a good printed article of which sheet deformation is less can be obtained.

In the twelfth aspect, the same matters as the matters specified in the second to ninth aspects can be appropriately combined with each other.

An image forming method according to a thirteenth aspect comprises: a test pattern printing step of printing a test pattern by ink jet means for jetting ink containing a color material and transparent liquid jet means for jetting transparent liquid and in which the ink and the transparent liquid are applied to different regions on the same medium and ink application regions to which the ink is applied and transparent liquid application regions to which the transparent liquid is applied are arranged adjacent to each other; an information acquisition step of acquiring information representing the amount of medium deformation of the test pattern; an information processing step of determining the amount of transparent liquid to be jetted by the transparent liquid jet means for jetting the transparent liquid, from the information representing the amount of medium deformation acquired by the information acquisition step; and an image forming step of performing printing by jetting the ink by the ink jet means on the basis of print data and jetting the transparent liquid from the transparent liquid jet means according to the determined amount of transparent liquid to be jetted.

According to the thirteenth aspect, the amount of transparent liquid to be applied to a medium can be appropriately adjusted. Accordingly, a good printed article of which sheet deformation is less can be obtained.

In the image forming method according to the thirteenth aspect, the same matters as the matters specified in the second to ninth aspects can be appropriately combined with each other. In this case, means for serving processing or a function, which is specified in the device for determining the amount of transparent liquid to be jetted, can be grasped as elements of "steps" of processing or an operation corresponding thereto.

According to the invention, it is possible to correct the amount of transparent liquid to be jetted by a simple method.

DESCRIPTION OF THE PREFERRED EMBODIMENTS

Preferred embodiments of the invention will be described in detail below with reference to accompanying drawings.

Figure 1:
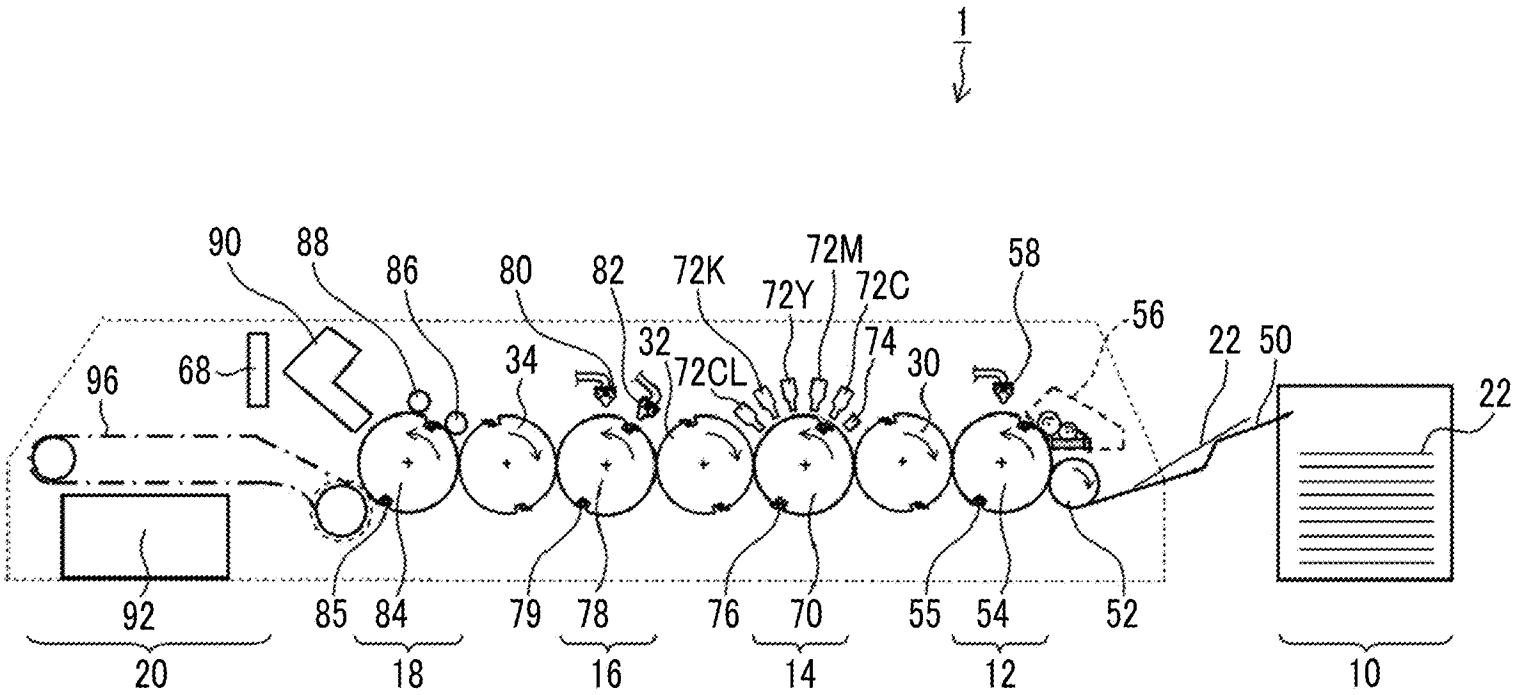
FIG. 1 is a view showing the structure of an ink jet printing apparatus according to an embodiment.

FIG. 1 is a view showing the structure of an ink jet printing apparatus 1 according to an embodiment. The ink jet printing apparatus 1 includes a sheet feed section 10, a treatment liquid applying section 12, a drawing section 14, a drying section 16, a fixing section 18, and a sheet discharge section 20. The ink jet printing apparatus 1 is a color ink jet printing apparatus that prints a color image on a sheet 22 with aqueous ink. The aqueous ink means ink in which a color material, such as dye or a pigment, is dissolved or dispersed in water and a solvent soluble in water. The sheet 22 used in this embodiment is a printing sheet that uses cellulose as a main component. The sheet 22 is one form of a medium that is used to form an image. The ink jet printing apparatus 1 is one form of an image forming apparatus.

The sheet feed section 10 is a mechanism that feeds the sheet 22 to the treatment liquid applying section 12. Sheets 22, which are sheets of paper, are stacked on the sheet feed section 10. The sheet feed section 10 is provided with a sheet feed tray 50 and the sheets 22 are fed to the treatment liquid applying section 12 from the sheet feed tray 50 one by one.

The treatment liquid applying section 12 is a mechanism that applies treatment liquid to the recording surface of the sheet 22. The treatment liquid contains a component that aggregates or thickens a color material (dye or a pigment) contained in ink. Specifically, examples of a method of aggregating or thickening the color material include a method using treatment liquid that reacts to ink to precipitate or insolubilize the color material contained in the ink, a method using treatment liquid that generates a semisolid material (gel) including the color material contained in the ink, and the like. Examples of means for causing the treatment liquid to react to the ink include: a method of making an anionic color material contained in the ink and a cationic compound contained in the treatment liquid react to each other; a method of mixing ink and treatment liquid, which have potentials of hydrogen (pH) different from each other, to change the pH of the ink, to cause the dispersion breakdown of dye contained in the ink, and to aggregate the dye; a method of causing the dispersion breakdown of dye contained in ink by the reaction of the dye to multivalent metal salt contained in treatment liquid to aggregate the dye; and the like. Examples of a method of applying treatment liquid include the application of treatment liquid using a roller, the uniform application of treatment liquid using a spray, the jet of treatment liquid using an ink jet head, and the like.

The treatment liquid applying section 12 shown in FIG. 1 includes a first delivery cylinder 52, a treatment liquid drum 54, a treatment liquid applying device 56, and a hot air blowing nozzle 58. The sheet 22, which is fed from the sheet feed section 10, is received by the first delivery cylinder 52 and is delivered to the treatment liquid drum 54.

The treatment liquid drum 54 includes claw-shaped grippers 55 provided on the outer peripheral surface thereof, and is adapted to be capable of holding front ends of sheets 22 by the grippers 55. The sheet 22 is transported while being rotated by the rotation of the treatment liquid drum 54 in a state in which the front end of the sheet 22 is held by the gripper 55. Suction holes are provided on the outer peripheral surface of the treatment liquid drum 54, and the treatment liquid drum 54 can be adapted to hold the sheet 22 on the peripheral surface thereof by suction from the suction holes.

The structure of the treatment liquid applying device 56 is not particularly limited. For example, the treatment liquid applying device 56 includes a treatment liquid container in which treatment liquid is stored, a measuring roller of which a part is immersed in the treatment liquid of the treatment liquid container, a squeegee that is in contact with the measuring roller, and a rubber roller that is in pressure contact with the measuring roller and the sheet 22 present on the treatment liquid drum 54 and transfers measured treatment liquid to the sheet 22. According to the treatment liquid applying device 56, a certain amount of treatment liquid can be applied to the sheet 22.

The sheet 22 to which treatment liquid has been applied by the treatment liquid applying device 56 is transported to the position of the hot air blowing nozzle 58. The hot air blowing nozzle 58 can be adapted to blow hot air to the sheet 22 at a certain flow rate. An infrared heater can be used to dry the sheet instead of the hot air blowing nozzle 58, or a combination of the hot air blowing nozzle 58 and an infrared heater can be used to dry the sheet.

The sheet 22 to which treatment liquid has been applied is delivered to a second delivery cylinder 30 from the treatment liquid drum 54. After that, the sheet 22 is delivered to a drawing drum 70 of the drawing section 14 from the second delivery cylinder 30.

The drawing section 14 is a mechanism that draws an image corresponding to an input image by jetting ink and transparent liquid by an ink jet method. The drawing section 14 includes the drawing drum 70, recording heads 72C, 72M, 72Y, and 72K as drawing means, a transparent liquid jet head 72CL, and a sheet floating sensor 74.

The drawing drum 70 holds the sheet 22 on the outer peripheral surface thereof and is rotationally driven. The drawing drum 70 includes claw-shaped grippers 76 provided on the outer peripheral surface thereof, and is adapted to be capable of holding front ends of sheets 22 by the grippers 76. The sheet 22 is transported while being rotated by the rotation of the drawing drum 70 in a state in which the front end of the sheet 22 is held by the gripper 76. Further, the drawing drum 70 includes a plurality of suction holes (not shown) provided on the peripheral surface thereof, and holds the sheets 22 on the peripheral surface thereof by the suction of the sheet 22 from the suction holes.

The sheet floating sensor 74 detects the floating of the sheet 22 held on the drawing drum 70. That is, the sheet floating sensor 74 detects the floating of the sheet 22, which is a certain distance or more, from the outer peripheral surface of the drawing drum 70. The sheet floating sensor 74 has, for example, a structure in which a laser projector and an optical receiver are disposed on both sides of the drawing drum 70 in an axial direction of the drawing drum 70. In a case in which the sheet 22 floats from the outer peripheral surface of the drawing drum 70 by a certain distance or more, laser light projected from the laser projector is blocked by the sheet 22 and is not received by the optical receiver. The sheet floating sensor 74 detects the floating of the sheet 22 from the amount of light received by the optical receiver.

The sheet floating sensor 74 is disposed on the upstream side of the recording heads 72C, 72M, 72Y, and 72K and the transparent liquid jet head 72CL in a sheet transport direction that is the rotational direction of the drawing drum 70.

In a case in which the floating of the sheet 22 is detected by the sheet floating sensor 74, control for stopping the rotation of the drawing drum 70 or the like is performed to avoid the contact between the floating sheet 22 and the nozzle surfaces of the recording heads 72C, 72M, 72Y, and 72K and the nozzle surface of the transparent liquid jet head 72CL.

The recording heads 72C, 72M, 72Y, and 72K are ink jet heads that correspond to ink having four colors of cyan (C), magenta (M), yellow (Y), and black (K), respectively, and jet ink droplets having the corresponding colors. Each of the recording heads 72C, 72M, 72Y, and 72K corresponds to one form of ink jet means.

The transparent liquid jet head 72CL is an ink jet head that jets transparent liquid droplets. The transparent liquid jet head 72CL corresponds to one form of transparent liquid jet means. There is a case in which the transparent liquid is referred to as "clear ink". The transparent liquid is written as "CL". Further, there is a case in which ink containing a color material having a color of each of C, M, Y, and K is referred to as "color ink".

Ink is supplied to each of the recording heads 72C, 72M, 72Y, and 72K from an ink tank (not shown), which is an ink supply source corresponding to a corresponding color, through a pipe line (not shown). Further, transparent liquid is supplied to the transparent liquid jet head 72CL from a transparent liquid tank (not shown), which is a supply source of transparent liquid, through a pipe line (not shown).

The recording heads 72C, 72M, 72Y, and 72K and the transparent liquid jet head 72CL are disposed close to positions that face the outer peripheral surface of the drawing drum 70. The recording heads 72C, 72M, 72Y, and 72K and the transparent liquid jet head 72CL are disposed in this order from the upstream side in the rotational direction of the drawing drum 70.

Each of the recording heads 72C, 72M, 72Y, and 72K and the transparent liquid jet head 72CL is a full-line type ink jet head that has a length corresponding to the maximum width of an image forming region of the sheet 22, and a nozzle array in which a plurality of nozzles for jetting liquid droplets are arranged over the entire width of the image forming region is formed on the jet surface of each head.

The recording heads 72C, 72M, 72Y, and 72K and the transparent liquid jet head 72CL are fixed and installed so as to extend in a direction orthogonal to the transport direction of the sheet 22, that is, the rotational direction of the drawing drum 70.

The configuration of the standard colors (four colors) of CMYK has been exemplified in this embodiment. However, the combinations of the colors of ink or the number of the colors are not limited to those of this embodiment, and light ink, dark ink, special color ink, and the like may be added. For example, recording heads for jetting light-color ink (light ink) having colors, such as a light cyan color and a light magenta color, can be added; recording heads for jetting ink having special colors, such as a green color and an orange color, can also be added; and the arrangement order of the recording heads for the respective colors is also not particularly limited.

Since the transparent liquid jet head 72CL among the recording heads 72C, 72M, 72Y, and 72K and the transparent liquid jet head 72CL is disposed on the most downstream side in the rotational direction of the drawing drum 70, the ink jet printing apparatus 1 of FIG. 1 is adapted to jet transparent liquid after jetting the respective color inks. However, the transparent liquid jet head 72CL may be disposed on the upstream side of the recording heads 72C, 72M, 72Y, and 72K for the color inks, and may be disposed between any two of the recording heads 72C, 72M, 72Y, and 72K for the color inks.

Ink droplets are jetted to the recording surface of the sheet 22, which is held on the outer peripheral surface of the drawing drum 70, from the recording heads 72C, 72M, 72Y, and 72K. Accordingly, ink is in contact with the treatment liquid present on the treatment liquid applying section 12 and color materials (dye) dispersed in the ink are aggregated, so that color material aggregates are formed. Therefore, the flow or the like of the color materials on the sheet 22 is prevented, so that an image is formed on the recording surface of the sheet 22.

Further, transparent liquid droplets are jetted to the recording surface of the sheet 22, which is held on the outer peripheral surface of the drawing drum 70, from the transparent liquid jet head 72CL.

The jet timing of each of the recording heads 72C, 72M, 72Y, and 72K and the transparent liquid jet head 72CL is synchronized with an encoder (not shown in FIG. 1) that is disposed on the drawing drum 70 and detects a rotational speed.

The recording heads 72C, 72M, 72Y, and 72K and the transparent liquid jet head 72CL are mounted on a carriage (not shown) and form one head unit. The carriage is provided to be movable between the drawing section 14 and a maintenance section (not shown). The maintenance section is a processing section that performs the cleaning, capping for moisturizing, and the like of each of the recording heads 72C, 72M, 72Y, and 72K and the transparent liquid jet head 72CL. The maintenance section is installed side by side with the drawing drum 70 in the axial direction of the rotation axis of the drawing drum 70.

Cleaning of the nozzle surface, preliminary jetting, pressure purge, and other maintenance operations of each of the recording heads 72C, 72M, 72Y, and 72K and the transparent liquid jet head 72CL are performed by the maintenance section after the head unit is retreated from the drawing drum 70.

The sheet 22 to which color ink and transparent liquid have been applied by the drawing section 14 is delivered to a third delivery cylinder 32 from the drawing drum 70. The sheet 22, which is delivered to the third delivery cylinder 32, is delivered to a drying drum 78 of the drying section 16 from the third delivery cylinder 32.

The drying section 16 dries a liquid component remaining on the sheet 22 to which the image has been recorded. The solvent of the ink and the transparent liquid, which are separated by an action for aggregating a color material, are included in the liquid component remaining on the sheet 22.

The drying section 16 includes the drying drum 78, a first hot air blowing nozzle 80 that is first drying means, and a second hot air blowing nozzle 82 that is second drying means.

The drying drum 78 is a drum that holds the sheet 22 on the outer peripheral surface thereof and transports the sheet 22 while being rotated. The drying drum 78 includes claw-shaped grippers 79 provided on the outer peripheral surface thereof, and is adapted to be capable of holding front ends of sheets 22 by the grippers 79. The sheet 22 is transported while being rotated by the rotation of the drying drum 78 in a state in which the front end of the sheet 22 is held by the gripper 79.

The first hot air blowing nozzle 80 and the second hot air blowing nozzle 82 are disposed at positions that face the outer peripheral surface of the drying drum 78. Hot air is sent to the recording surface of the sheet 22, which is held and transported by the drying drum 78, from the first hot air blowing nozzle 80 and the second hot air blowing nozzle 82, so that drying processing is performed.

The ink jet printing apparatus 1 includes a temperature/humidity sensor 68 as temperature/humidity measuring means, and measures the temperature and humidity of air around the apparatus by the temperature/humidity sensor 68. The conditions of the drying processing of the drying section 16 are controlled on the basis of the measurement information of the temperature/humidity sensor 68.

The sheet 22, which has been subjected to drying processing performed by the drying section 16, is delivered to a fourth delivery cylinder 34 from the drying drum 78. The sheet 22, which is delivered to the fourth delivery cylinder 34, is delivered to a fixing drum 84 of the fixing section 18 from the fourth delivery cylinder 34.

The fixing section 18 includes the fixing drum 84, a first fixing roller 86, a second fixing roller 88, and an in-line sensor unit 90. The first fixing roller 86, the second fixing roller 88, and the in-line sensor unit 90 are disposed at positions that face the peripheral surface of the fixing drum 84, and are disposed in this order from the upstream side in the rotational direction of the fixing drum 84.

The fixing drum 84 is a drum that holds the sheet 22 on the outer peripheral surface thereof and transports the sheet 22 while being rotated. The fixing drum 84 includes claw-shaped grippers 85 provided on the outer peripheral surface thereof, and is adapted to be capable of holding front ends of sheets 22 by the grippers 85. The sheet 22 is transported while being rotated by the rotation of the fixing drum 84 in a state in which the front end of the sheet 22 is held by the gripper 85.

Fixing processing, which is performed by the first and second fixing rollers 86 and 88, and check, which is performed by the in-line sensor unit 90, are performed on the recording surface of the sheet 22 that is held and transported by the fixing drum 84.

Each of the first and second fixing rollers 86 and 88 has the same width as the width of the fixing drum 84, and is heated up to a set temperature by a heater (not shown) that is built therein. The first and second fixing rollers 86 and 88 melts fine particles of a self-dispersing polymer, which is a thermoplastic resin contained in the ink, and forms the ink in the shape of a film by heating and pressurizing the ink that is applied to the recording surface of the sheet 22.

The in-line sensor unit 90 is a detection unit that includes a charge-coupled device (CCD) line sensor as image reading means for reading the image recorded on the sheet 22 and laser displacement meters as sheet deformation measurement means for measuring the sheet deformation of a printed article.

The in-line sensor unit 90 picks up the image, which is recorded on the sheet 22 transported by the fixing drum 84, by the CCD line sensor, and reads the printed image. Information, such as the density of the image, the jetting failure of the recording head 72C, 72M, 72Y, and 72K, is obtained from the data of the read image that is read by the CCD line sensor.

Further, a plurality of laser displacement meters of the in-line sensor unit 90 are installed at positions that are different from each other in the width direction of the sheet 22, and each of the laser displacement meters measures the amount of deformation of the sheet 22 transported by the fixing drum 84 after the drying processing is performed by the drying section 16.

The sheet 22, which has been subjected to the fixing processing by the fixing section 18, is delivered to a chain transport section 96 from the fixing drum 84, and is sent to the sheet discharge section 20 by the chain transport section 96.

The sheet discharge section 20 recovers sheets 22 on which images have been formed. The sheet discharge section 20 includes a sheet discharge tray 92 on which sheets 22 are stacked and recovered. Grippers (not shown) of the chain transport section 96 release the grip of the sheets 22 on the sheet discharge tray 92, and stack the sheets 22 on the sheet discharge tray 92.

[Structure Example of Ink Jet Head Bar]

Next, a structure example of an ink jet head bar 110, which can be used as each of the recording heads 72C, 72M, 72Y, and 72K and the transparent liquid jet head 72CL, will be described. The recording heads 72C, 72M, 72Y, and 72K and the transparent liquid jet head 72CL can have a common structure.

Figure 2:
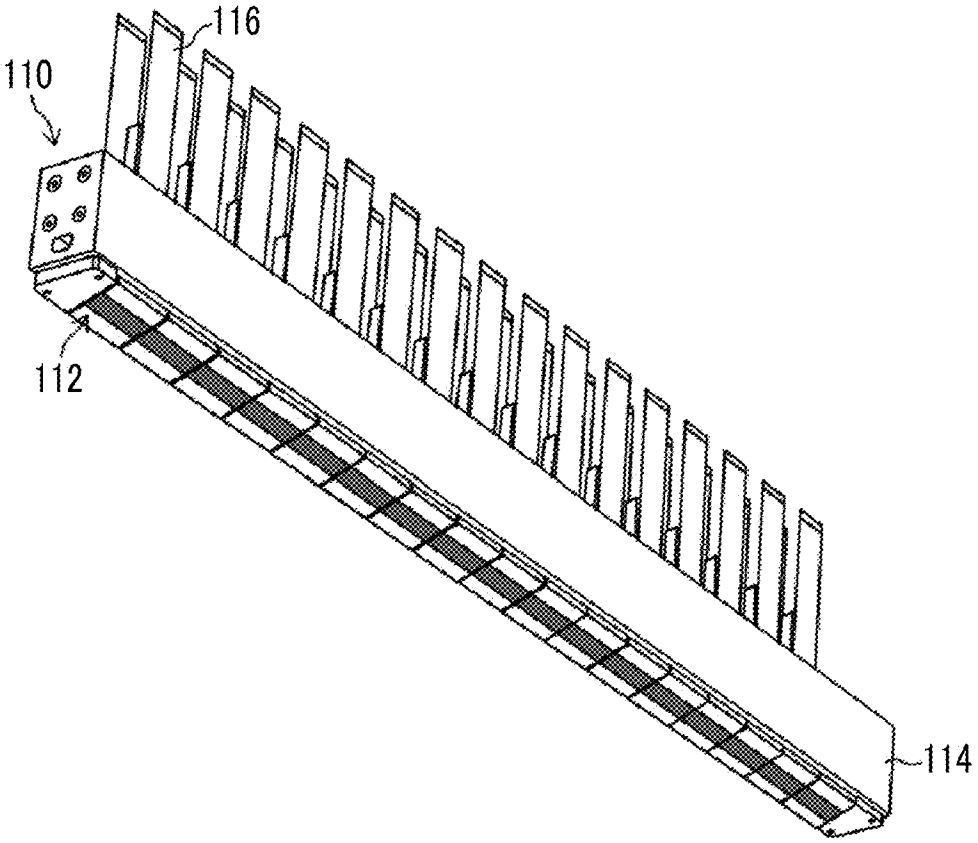
FIG. 2 is a perspective view of an ink jet head bar.

FIG. 2 is a perspective view of the ink jet head bar 110. The jet surface of the ink jet head bar 110, which is seen obliquely from below, is shown in FIG. 2. The ink jet head bar 110 is formed of a full-line type line head in which a plurality of head modules 112 are arranged in a sheet width direction so as to be long. The full-line type line head is also referred to as a page wide head.

An example in which seventeen head modules 112 are connected to each other has been shown in FIG. 2, but the structure of the head module 112 and the number and arrangement form of head modules 112 are not limited to the example shown in FIG. 2. Reference numeral 114 in FIG. 2 denotes a base frame as a frame body that is used to connect and fix the plurality of head modules 112 in the shape of a bar. Reference numeral 116 denotes a flexible substrate that is connected to each head module 112. The plurality of head modules 112 are mounted on the base frame 114 and are integrated with each other, so that one ink jet head bar 110 is formed.

Figure 3:
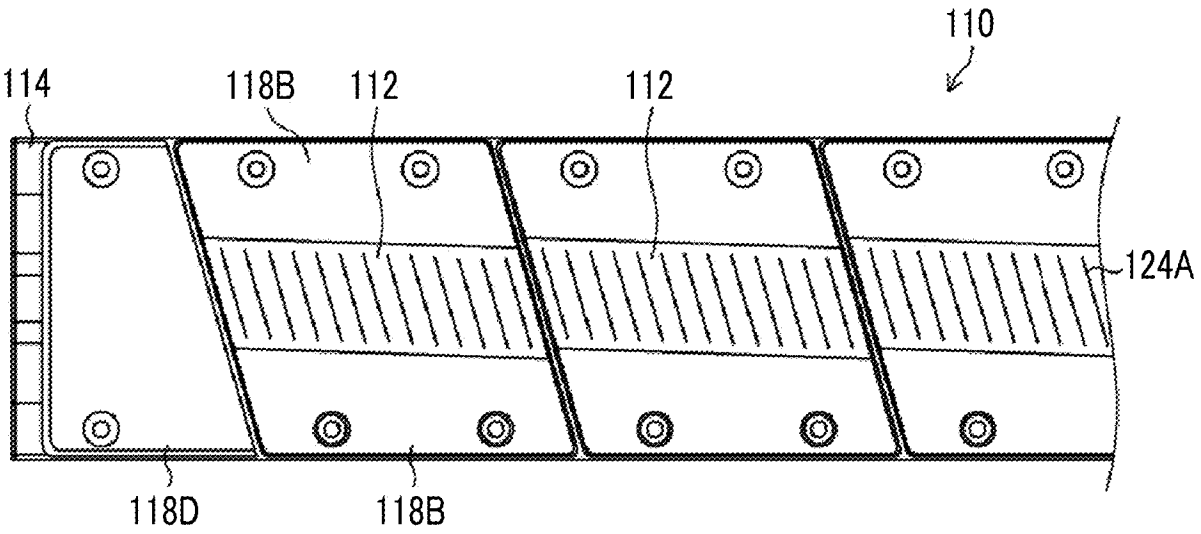
FIG. 3 is a partial enlarged view of the ink jet head bar seen from a nozzle surface side.

FIG. 3 is a partial enlarged view of the ink jet head bar 110 seen from a nozzle surface side. Each of the head modules 112 is supported from both sides thereof in the vertical direction in FIG. 3, which is the lateral direction of the ink jet head bar 110, by module support members 118B and is mounted on the base frame 114 through the module support members 118B. Further, both end portions of the ink jet head bar 110 in the longitudinal direction are supported by head-protection members 118D.

Each nozzle is not shown in FIG. 3, but an oblique solid line denoted by reference numeral 124A represents a nozzle array in which a plurality of nozzles are arranged in a line.

Figure 4:
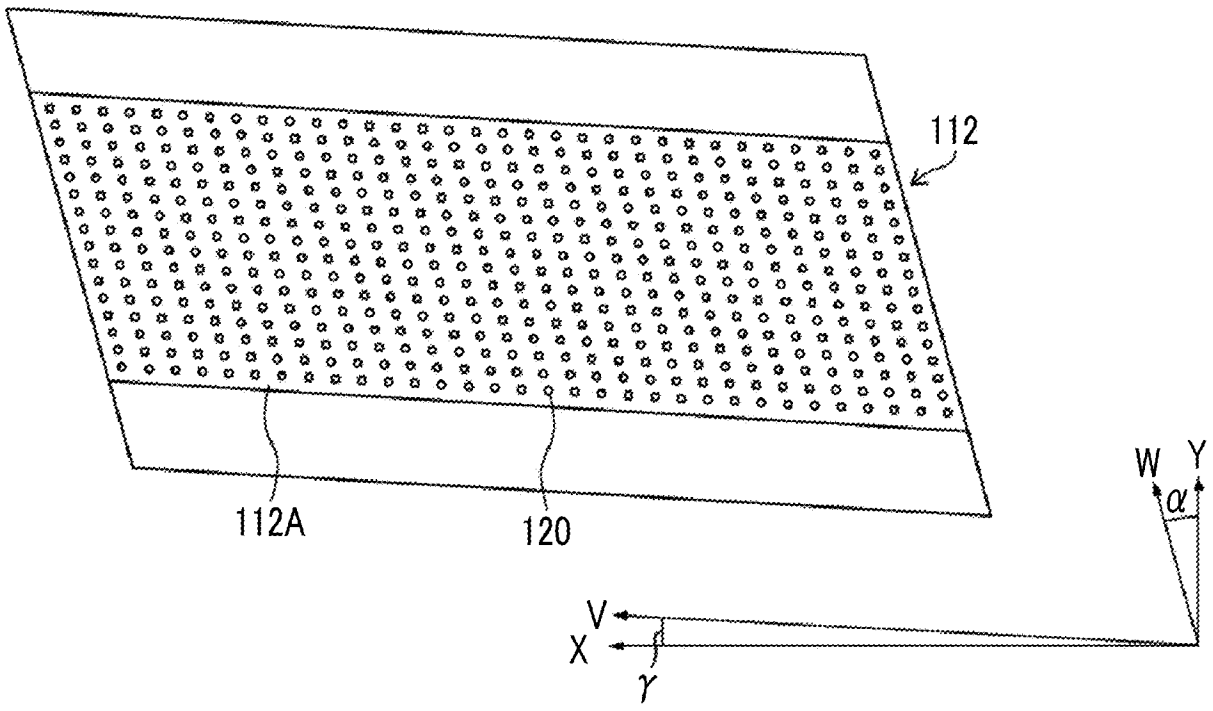
FIG. 4 is a plan view of the nozzle surface of a head module seen from a jet side.

FIG. 4 is a plan view of a nozzle surface 112A of the head module 112 seen from a jet side. The nozzles of which the number is reduced are shown in FIG. 4 for convenience of illustration, but for example, 32×64 nozzles 120 are two-dimensionally arranged on the nozzle surface 112A of one head module 112. The "nozzle surface" means the jet surface on which the nozzles 120 are formed, and is synonymous with "nozzle-forming surface". The nozzle arrangement of the plurality of nozzles 120, which are two-dimensionally arranged, is referred to as "two-dimensional nozzle arrangement".

A Y direction in FIG. 4 is the sheet transport direction, and an X direction orthogonal to the Y direction is the sheet width direction. A direction parallel with the Y direction is referred to as a "sub-scanning direction", and a direction parallel with the X direction is referred to as a "main scanning direction".

The head module 112 includes an end face corresponding to a long side parallel with a V direction, which is inclined with respect to the X direction by an angle γ, and an end face corresponding to a short side parallel with a W direction, which is inclined with respect to the Y direction by an angle α; and has the shape of a parallelogram in plan view.

In a case in which the plurality of head modules 112 are connected to each other in the X direction (see FIG. 2), a nozzle array covering the entire drawing range of a sheet in the X direction is formed. Accordingly, a full-line type head, which can record an image with a prescribed recording resolution by one time of drawing scanning, is formed. The prescribed recording resolution may be a recording resolution that is predetermined by the ink jet printing apparatus 1, and may be a recording resolution that is set by user's selection or automatic selection performed by a program corresponding to a printing mode. For example, 1200 dpi can be set as the recording resolution. dpi (dot per inch) is a unit that means the number of dots per inch.

In the case of an ink jet head having two-dimensional nozzle arrangement, a projected nozzle array, which is obtained when the respective nozzles of the two-dimensional nozzle arrangement are projected (orthogonally projected) so as to be arranged in the main scanning direction, can be regarded as a nozzle array equivalent to a nozzle array in which the respective nozzles are arranged in a line at substantially regular intervals in the main scanning direction with a nozzle density at which the maximum recording resolution is achieved. "substantially regular intervals" means that jet points capable of being recorded by the ink jet printing apparatus are arranged at substantially regular intervals. For example, a case in which nozzles arranged at slightly different intervals in consideration of the movement of liquid droplets on a sheet caused by manufacturing errors or landing interference are included is also included in the concept of "regular intervals". Considering the projected nozzle array (referred to as a "substantial nozzle array"), nozzle numbers representing the nozzle positions can be given in the order of the projected nozzles arranged in the main scanning direction.

In a case in which the invention is embodied, the arrangement form of the nozzles 120 of the head module 112 is not limited to the example shown in the drawing and various arrangement forms of the nozzles can be employed. For example, a linear nozzle arrangement, a V-shaped nozzle arrangement, a folded line-shaped nozzle arrangement, such as W-shaped nozzle arrangement having V-shaped nozzle arrangement as a repeating unit, and the like can be employed instead of the matrix-like arrangement form described in FIG. 4.

An image having a prescribed recording resolution can be recorded in an image forming region of a sheet by a single operation for moving a sheet 22 relative to the ink jet head bar 110 (see FIG. 2) in which a plurality of head modules 112 having such a nozzle arrangement are combined, that is, single sub-scanning. A drawing method, which can finish an image by single drawing scanning, is referred to as a single-pass printing method.

Figure 5:
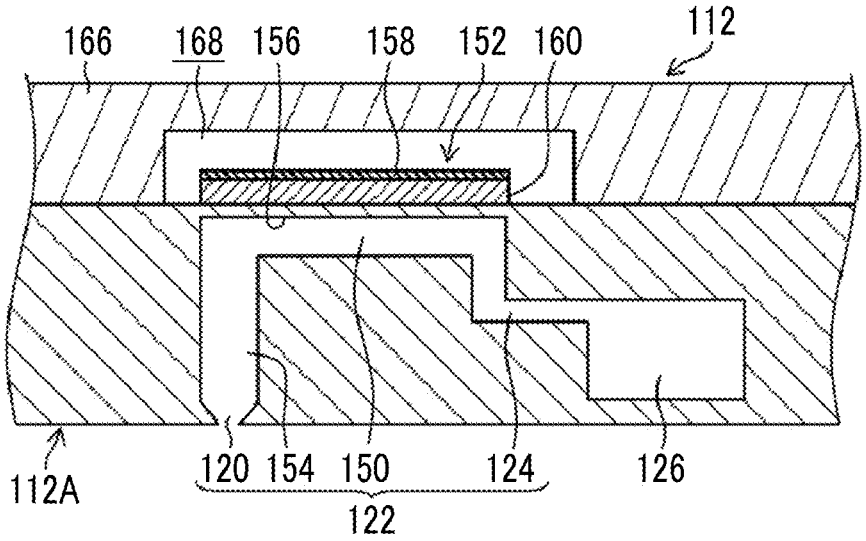
FIG. 5 is a longitudinal sectional view showing the steric structure of one ejector of the head module.

FIG. 5 is a longitudinal sectional view showing the steric structure of one ejector 122 of the head module 112. The ejector 122 includes a nozzle 120, a pressure chamber 150 that communicates with the nozzle 120, and a piezoelectric element 152. The nozzle 120 communicates with the pressure chamber 150 through a nozzle channel 154. The pressure chamber 150 communicates with a supply-side common branch channel 126 through an individual supply channel 124.

A vibration plate 156, which forms the upper surface of the pressure chamber 150, includes a conductive layer (not shown) that functions as a common electrode corresponding to a lower electrode of the piezoelectric element 152. Wall portions of other channel portions of the pressure chamber 150, the vibration plate 156, and the like can be made of silicon. The material of the vibration plate 156 is not limited to silicon, and the vibration plate 156 may also be made of a non-conductive material, such as a resin. A conductive layer made of a conductive material is formed on the surface of the vibration plate member. The vibration plate 156 itself is made of a metal material, such as stainless steel, and the vibration plate may also function as a common electrode.

A piezoelectric unimorph actuator is formed by a structure in which the piezoelectric element 152 is stacked on the vibration plate 156. A piezoelectric body 160 is deformed by the application of a drive voltage to an individual electrode 158, which is an upper electrode of the piezoelectric element 152, and bends the vibration plate 156, so that the volume of the pressure chamber 150 is changed. Liquid droplets are jetted from the nozzle 120 by a change in pressure that is caused by a change in volume. In a case in which the piezoelectric element 152 returns to the original state after the liquid droplets are jetted, the pressure chamber 150 is filled with new liquid (color ink or transparent liquid) from the supply-side common branch channel 126 through the individual supply channel 124. An operation for filling the pressure chamber 150 with liquid is referred to as "refill". A structure in which the vibration plate 156 is bent using the strain deformation of a d31 mode of the piezoelectric body 160 has been exemplified in this embodiment, but a form in which a d33 mode is used and a form in which liquid is jetted using a shear mode (shear deformation) can also be employed.

The shape of the pressure chamber 150 in plan view is not particularly limited, and may be various forms, such as a polygonal shape, a circular shape, and an oval shape, in addition to a quadrangular shape. Reference numeral 166 in FIG. 5 denotes a cover plate. The cover plate 166 is a member that ensures a movable space 168 for the piezoelectric element 152 and seals the periphery of the piezoelectric element 152.

A supply-side liquid chamber and a recovery-side liquid chamber (not shown) are formed above the cover plate 166. The supply-side liquid chamber is connected to a supply-side channel (not shown) as a liquid supply source through a communication channel (not shown). The recovery-side liquid chamber is connected to a recovery-side channel (not shown) as a liquid recovery destination through a communication channel (not shown).

<Processing for Correcting Amount of Transparent Liquid to be Jetted>

Figure 6:
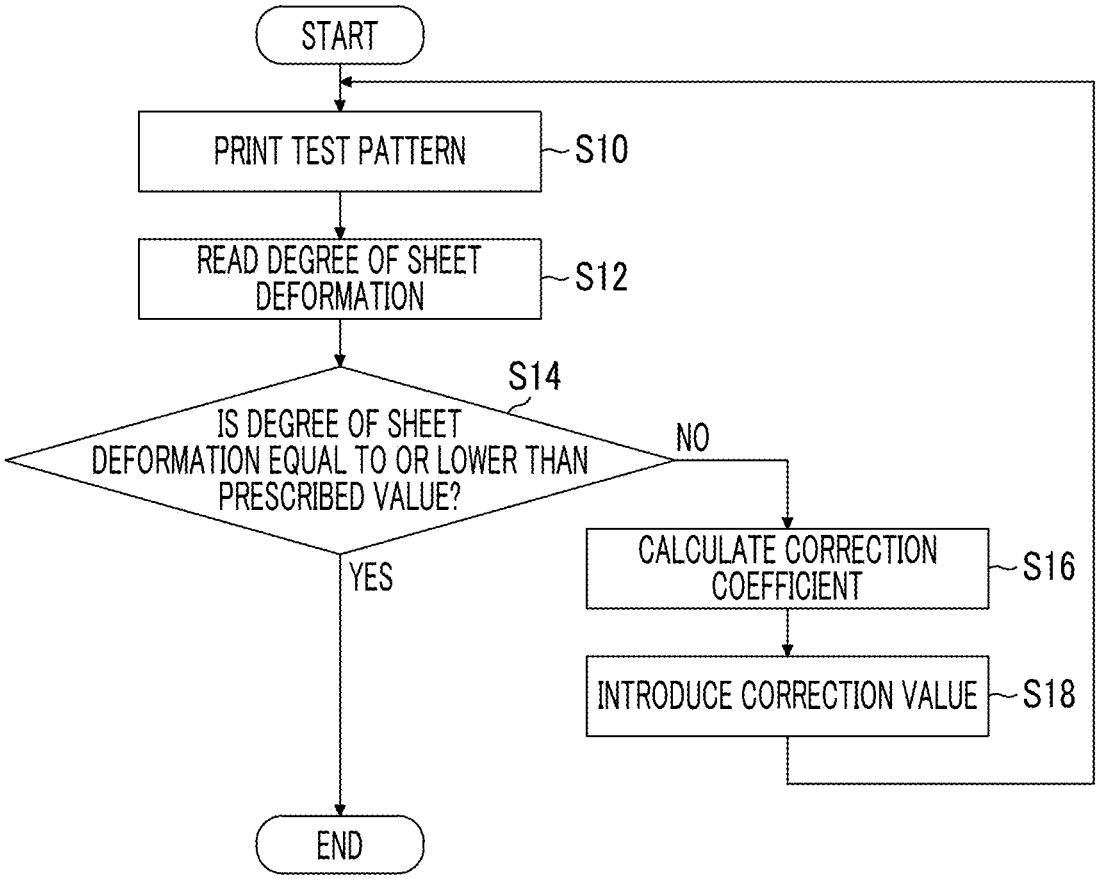
FIG. 6 is a flow chart showing the flow of processing for correcting the amount of transparent liquid to be jetted.

FIG. 6 is a flow chart showing the flow of processing for correcting the amount of transparent liquid to be jetted. The flow chart of FIG. 6 is performed according to a command of a system controller that controls the operation of the ink jet printing apparatus 1. The processing for correcting the amount of transparent liquid to be jetted includes a test pattern printing step (Step S10), a sheet-deformation-degree reading step (Step S12), a correction-necessity determining step (Step S14), a correction coefficient calculating step (Step S16), and a correction value introducing step (Step S18). Each step will be described below.

[Test Pattern Printing Step]

The test pattern printing step (Step S10) is a step of printing a test pattern by the ink jet printing apparatus 1.

Figure 7:
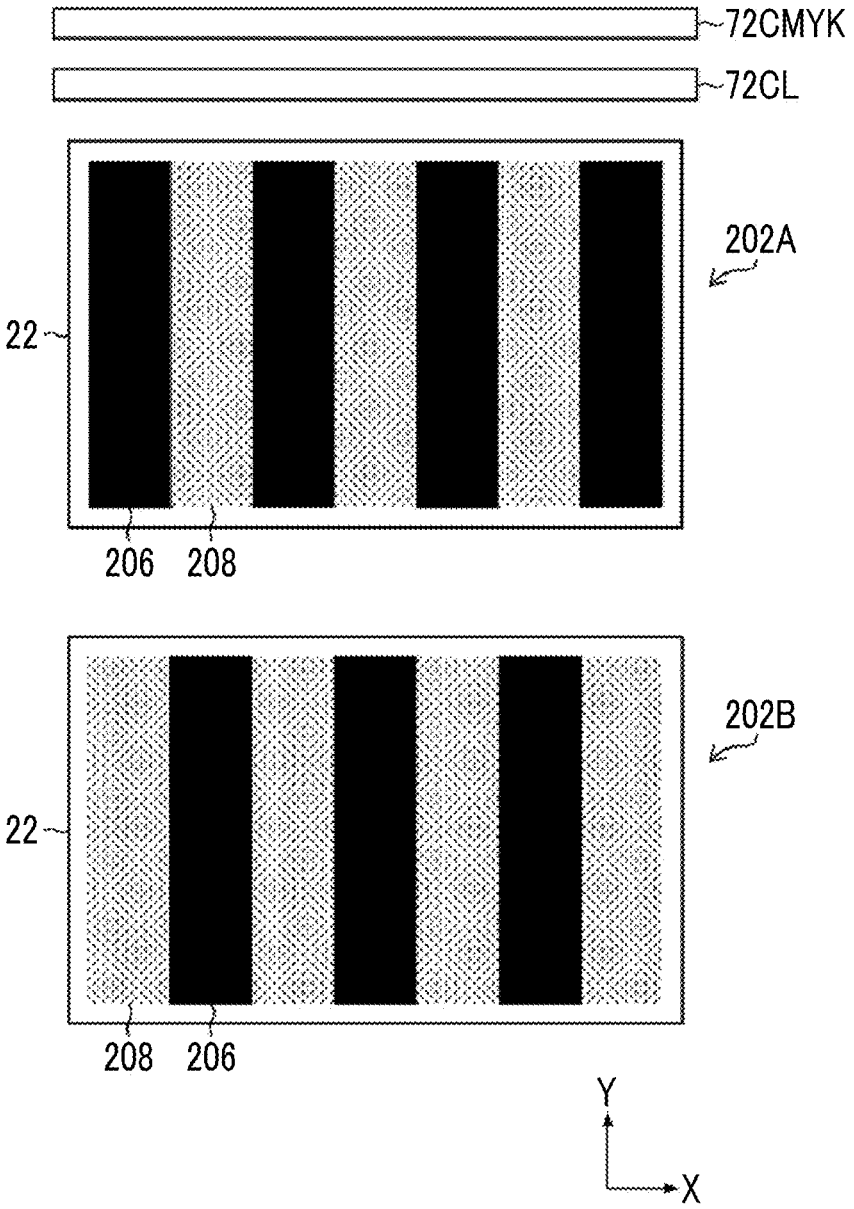
FIG. 7 is a view showing an example of a test pattern.

FIG. 7 is a view showing an example of the test pattern to be printed. In FIG. 7, the sheet transport direction will be described as a Y direction and the sheet width direction orthogonal to the sheet transport direction will be described as an X direction.

In FIG. 7, the recording heads corresponding to the respective colors of CMYK are collectively and simply written as a recording head 72CMYK. 72CL of FIG. 7 denotes the transparent liquid jet head. Each of the recording head 72CMYK and the transparent liquid jet head 72CL includes nozzle arrays in which a plurality of nozzles are arranged at positions different from each other in the X direction. A direction in which the plurality of nozzles of each of the recording head 72CMYK and the transparent liquid jet head 72CL are arranged is referred to as a "nozzle array direction". In the case of FIG. 7, the X direction is the nozzle array direction. The Y direction of FIG. 7 is a direction perpendicular to the nozzle array direction and is referred to as a "nozzle-array-perpendicular direction". The nozzle array direction corresponds to a "first direction", and the nozzle-array-perpendicular direction corresponds to a "second direction".

The test pattern 202A illustrated in FIG. 7 is formed of a pattern in which stripes extending in the nozzle-array-perpendicular direction are printed with color ink and transparent liquid is jetted between the plurality of stripes as portions printed with color ink. A region to which color ink is to be applied is referred to as an ink application region 206. A black color in which four color inks of CMYK are superimposed is printed in the ink application region 206 of this embodiment.

A region to which transparent liquid is to be applied is referred to as a transparent liquid application region 208. For convenience of description, there is a case in which the transparent liquid application region 208 is expressed as a "stripe of transparent liquid". Further, there is a case in which jetting transparent liquid is expressed as "printing" with transparent liquid.

That is, the test pattern 202A is formed of a pattern in which ink and transparent liquid are applied to different regions of the same sheet 22 (that is, a single sheet 22) and the ink application regions 206 and the transparent liquid application regions 208 are alternately arranged in the X direction. In the case of the stripe-like pattern, a test pattern 202B in which the ink application regions 206 and the transparent liquid application regions 208 are replaced with each other as shown in the lower stage of FIG. 7 also needs to be printed.

In the case of a pattern in which the ink application regions and the transparent liquid application regions are arranged adjacent to each other as shown in FIG. 7, the degree of sheet deformation is most likely to be understood, that is, a signal-to-noise ratio (S/N ratio) at the time of measurement of the amount of sheet deformation is high. Accordingly, the results of the measurement are likely to be stable. However, in a case in which the invention is embodied, the form of the test pattern is not limited to the example of FIG. 7 and various forms can be employed.

Figure 8A:
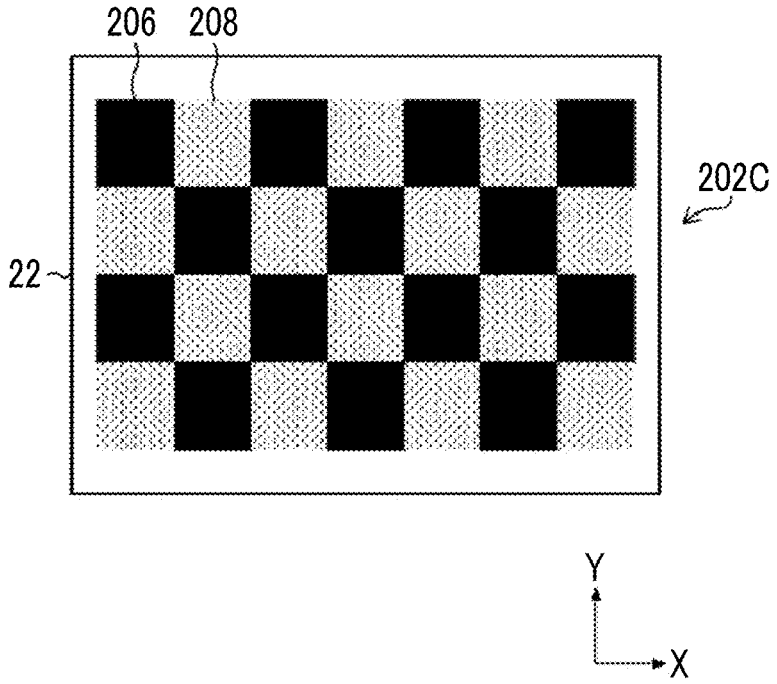
FIG. 8A is a view showing another example of the test pattern.
Figure 8B:
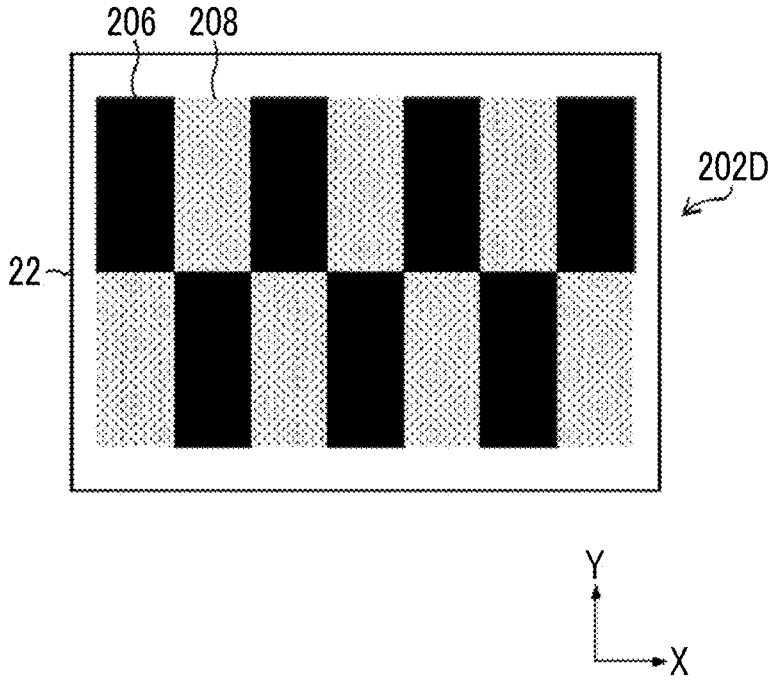
FIG. 8B is a view showing still another example of the test pattern.

For example, test patterns shown in FIGS. 8A and 8B may be used instead of the form illustrated in FIG. 7. The test pattern 202C shown in FIG. 8A is a checker flag type pattern. The test pattern 202D shown in FIG. 8B has a form in which the stripe-like test pattern 202A shown in the upper stage of FIG. 7 and the stripe-like test pattern 202B shown in the lower stage of FIG. 7 are reduced in length in the Y direction (so as to have about a half of the length) and these stripe-like patterns are connected to each other in the vertical direction and are printed as one pattern on the same sheet as a whole.

It is understood that the ink application regions 206 and the transparent liquid application regions 208 of the test pattern 202C shown in FIG. 8A and the test pattern 202D illustrated in FIG. 8B are also "stripe-like".

The ink application regions 206 and the transparent liquid application region 208 are arranged adjacent to each other in the nozzle array direction. A case in which the ink application regions 206 and the transparent liquid application regions 208 are adjacent to each other so that the boundaries of the ink application regions 206 and the transparent liquid application regions 208 are in contact with each other has been described in this embodiment, but a small gap may be formed between the ink application region 206 and the transparent liquid application region 208. That is, it is understood that a case in which both the ink application regions 206 and the transparent liquid application regions 208 are arranged so as to have a small gap therebetween also corresponds to "arranged adjacent to each other".

In the case of the test pattern 202C shown in FIG. 8A, transparent liquid is jetted over the entire range of the nozzle array of the transparent liquid jet head 72CL in the test pattern 202C. Accordingly, a test pattern in which the ink application regions 206 and the transparent liquid application regions 208 of the test pattern 202C shown in FIG. 8A are replaced with each other does not need to be printed. In this regard, since the same also applies to the test pattern 202D shown in FIG. 8B, a test pattern in which the ink application regions 206 and the transparent liquid application regions 208 of the test pattern 202D shown in FIG. 8B are replaced with each other does not need to be printed.

[As for Relationship Between Structure of Transparent Liquid Jet Head and Test Pattern]

As described in FIGS. 2 to 4, the full-line type head often has a structure in which a plurality of head modules are combined. Further, since the jet performances of the head modules slightly vary, there is often a variation in the amount of ink to be jetted from the head module. For this reason, it is preferable that the amount of ink to be jetted is adjusted by the head module as a unit, and it is preferable that each of the stripes of the transparent liquid application regions to which transparent liquid is to be jetted has a width corresponding to an integer multiple of the width of the head module of the transparent liquid jet head in the X direction. That is, it is preferable that the width of the transparent liquid application region in the X direction corresponds to the width of N head modules in a case in which N is an integer equal to or larger than 1.

Figure 9:
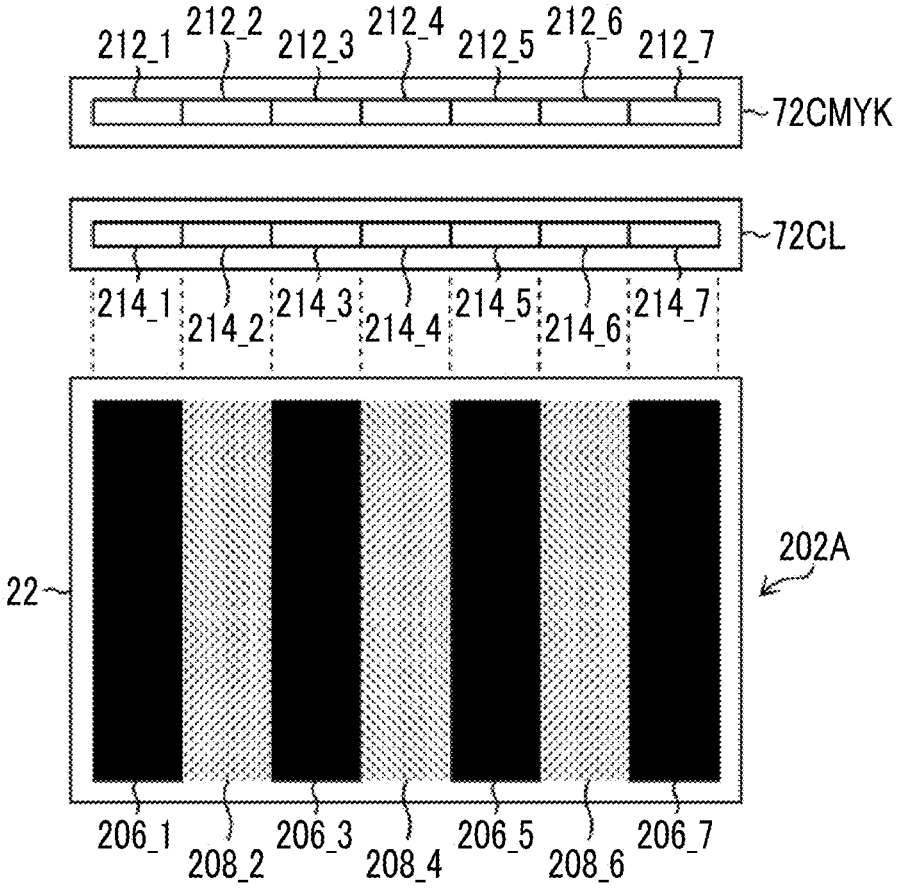
FIG. 9 is a view showing a relationship between the width of each stripe of the test pattern and the head modules.

FIG. 9 is a view showing a relationship between the width of each stripe of the test pattern 202A and head modules 214_*r*. Subscript "r" is an index representing the number of the head module, and "r", which is mentioned here, is an integer in the range of 1 to 7. FIG. 9 is a view showing an example of a form in which the width of each head module 214_*r* in the X direction and the width of each transparent liquid application region 208 in the X direction correspond to each other and the stripe of one transparent liquid application region 208 is formed by one head module. That is, FIG. 9 shows an example of a case in which N is 1.

In FIG. 9, the recording head 72CMYK for color ink has a structure in which seven head modules 212_*r* are combined. Likewise, the transparent liquid jet head 72CL also has a structure in which seven head modules 214_*r* (r=1, 2, . . . , 7) are combined.

An ink application region 206_1 of the test pattern 202A shown in FIG. 9 is printed by the head module 212_1 of the recording head. Likewise, ink application regions 206_3, 206_5, and 206_7 are printed by the head modules 212_3, 212_5, and 212_7 of the corresponding positions, respectively.

A transparent liquid application region 208_2 of the test pattern 202A is printed by the head module 214_2 of the transparent liquid jet head 72CL. Likewise, transparent liquid application regions 208_2, 208_4, and 208_6 are printed by the head modules 214_2, 214_4, and 214_6 of the corresponding positions, respectively.

A test pattern 202B in which ink application regions 206_3, 206_5, and 206_7 and transparent liquid application regions 208_2, 208_4, and 208_6 are replaced with each other is not shown in FIG. 9. However, the respective stripes of the test pattern 202B are also printed by the head module as a unit likewise.

Figure 10:
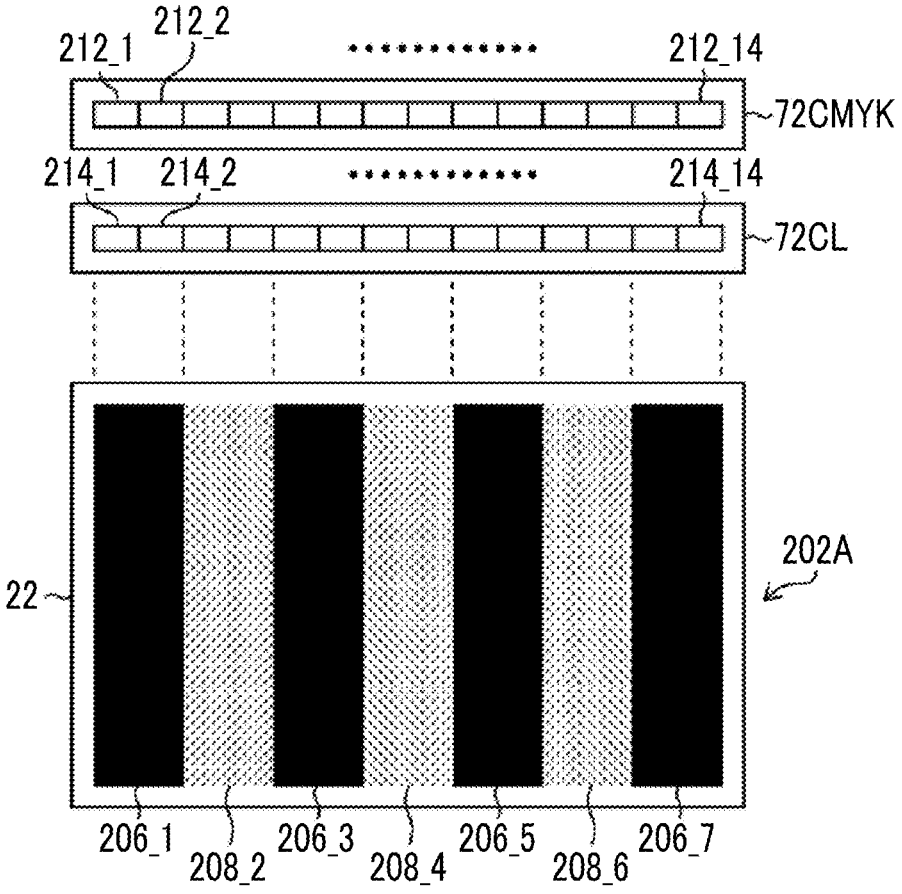
FIG. 10 is a view showing another example of the relationship between the width of each stripe of the test pattern and the head modules.

FIG. 10 is a view showing another example of the relationship between the width of each stripe of the test pattern 202A and head modules 214_*n*. FIG. 10 is a view showing an example of a form in which the width of two head modules in the X direction and the width of each transparent liquid application region 208 in the X direction correspond to each other and the stripe of one transparent liquid application region 208 is formed by two head modules. That is, FIG. 6 shows an example of a case in which N is 2.

In FIG. 10, the transparent liquid jet head 72CL includes fourteen head modules 214_*r* (r=1, 2, . . . , 14). Further, the recording head 72CMYK corresponding to color ink also includes fourteen head modules 212_*r* (r=1, 2, . . . , 14) likewise.

An ink application region 206_1 of the test pattern 202A is printed by the head modules 212_1 and 212_2 of the recording head 72CMYK. Likewise, each of ink application regions 206_3, 206_5, and 206_7 is printed by two head modules of the corresponding positions.

A transparent liquid application region 208_2 of the test pattern 202A is printed by the head modules 214_3 and 214_4 of the transparent liquid jet head 72CL. Likewise, each of transparent liquid application regions 208_4 and 208_6 is printed by two head modules of the corresponding positions.

A test pattern 202B in which the ink application regions 206 and the transparent liquid application regions 208 described in FIG. 7 are replaced with each other is not shown in FIG. 10. However, the respective stripes of the test pattern 202B are also printed by the plurality of adjacent head modules as a unit likewise.

[Sheet-Deformation-Degree Reading Step]

The sheet-deformation-degree reading step (Step S12) shown in FIG. 6 is a step of reading the degree of sheet deformation from a printed article on which the test pattern obtained by Step S10 is printed. The degree of sheet deformation is synonymous with the level of sheet deformation. A numerical value, which is obtained from the quantification of the degree of sheet deformation, is the amount of sheet deformation. "Read" include the acquisition of information.

The reading of the degree of sheet deformation is automatically or manually performed. A case in which the degree of sheet deformation is automatically read from a printed article on which the test pattern is printed is, for example, a form in which the degree of sheet deformation of the printed article on which the test pattern is printed is actually measured and information representing the degree of sheet deformation is obtained from the result of the measurement.

For example, a form in which an operator grasps the degree of sheet deformation through visual observation and/or tactile sensation corresponds to a case in which the degree of sheet deformation is "manually" read from a printed article on which the test pattern is printed. The degree of sheet deformation, which is read through visual observation and/or tactile sensation by the operator, can be evaluated or classified according to a predetermined criterion, and information representing the result of the evaluation or the result of the classification is treated as information representing the degree of sheet deformation. Here, an example of a case in which the degree of sheet deformation is automatically read will be described. The sheet-deformation-degree reading step (Step S12) corresponds to one form of an information acquisition step.

Figure 11:
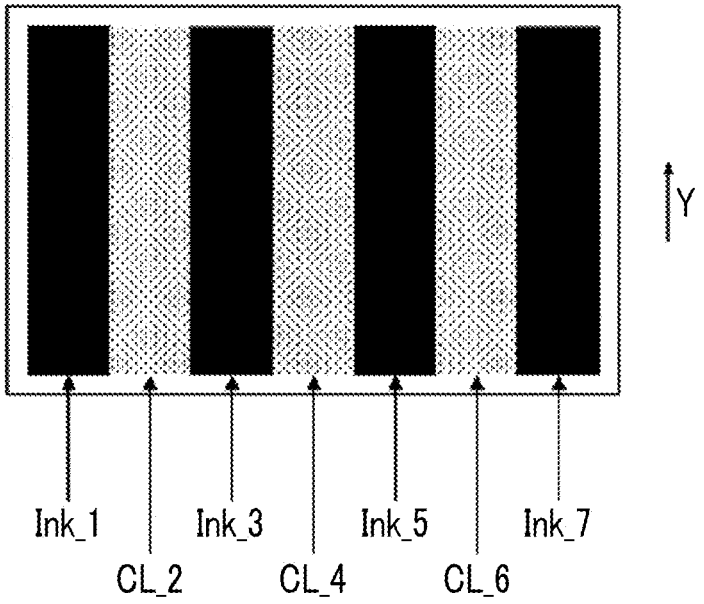
FIG. 11 is a view showing a case in which the degree of sheet deformation of the printed test pattern is automatically read.

FIG. 11 is a view showing a case in which the degree of sheet deformation of the test pattern 202A is automatically read. Ink_1, Ink_3, Ink_5, and Ink_7 shown in FIG. 11 represent the respective positions of different ink application regions. Further, CL_2, CL_4, and CL_6 represent the respective positions of different transparent liquid application regions 208 on the sheet 22.

The amounts of deformation of the sheet 22 at the respective positions of Ink_1, Ink_3, Ink_5, and Ink_7 and CL_2, CL_4, and CL_6 shown in FIG. 11 are measured. Specifically, the irregularity of the surface of the sheet is measured by measuring means (which is synonymous with measurement means), such as a laser displacement meter.

It is preferable that the amount of deformation of the sheet is measured at two positions, that is, left and right positions within the same stripe except for ends of the stripe of the ink application region 206 in the X direction. In the following description, left is denoted by "L" and right is denoted by "R". Of course, the stripe itself of the ink application region may be divided into two pieces instead of a form in which the amount of deformation of the sheet is measured at two positions, that is, left and right positions within one stripe in the X direction.

Figure 12:
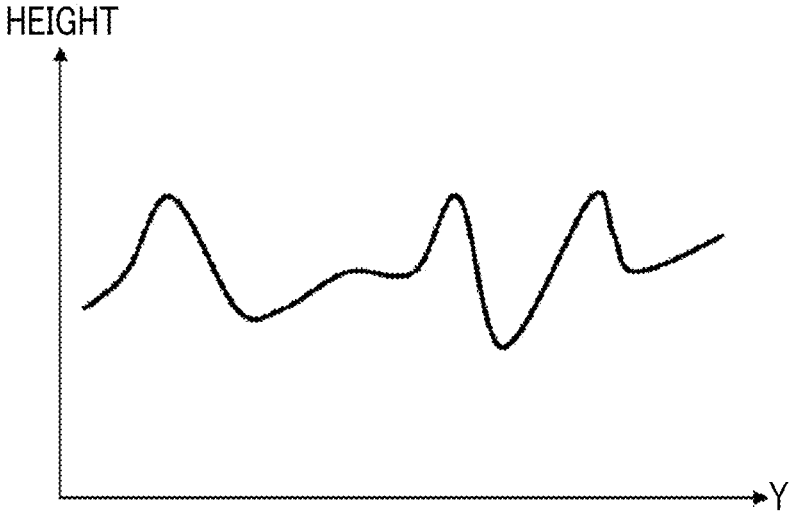
FIG. 12 is a view showing an example of the shape profile of the irregularity of the surface of a sheet.

FIG. 12 is a view showing an example of the shape profile of the irregularity of the surface of the sheet. A horizontal axis in FIG. 12 represents a position in the Y direction, and a vertical axis in FIG. 12 represents a height in a direction perpendicular to the surface of the sheet (Z direction). The irregularity of the surface of the sheet is measured by a laser displacement meter or the like, so that the shape profile shown in FIG. 12 is obtained.

The amount of sheet deformation, which represents the degree of sheet deformation, is obtained from this shape profile. Various indexes can be used as an index that quantitatively represents the amount of sheet deformation. Examples of an index, which can be used as the amount of sheet deformation, will be described below.

Example 1

The total length of the shape profile of the irregularity of the surface of the sheet can be employed as the amount of sheet deformation. The total length of a curve, which represents the shape profile shown in FIG. 12, reflects the degree of sheet deformation. The total length of the curve is reduced with a reduction in the level of sheet deformation, and the total length of the curve is increased with an increase in the level of sheet deformation.

In a case in which the shape profile of the irregularity of the surface of the sheet includes a component, such as the inclination of a measurement base, correction processing for removing the component of the inclination or the like is performed at the time of calculation of the amount of sheet deformation.

Example 2

The characteristic value of the shape profile of the irregularity of the surface of the sheet can be employed as the amount of sheet deformation. For example, arithmetic mean roughness Ra, the maximum height, M-point mean height (here, M represents an integer of about 10), or an appropriate combination thereof can be used as the characteristic value of the shape profile.

Example 3

Since a main object of the invention is to suppress the deterioration of quality of a print sample caused by sheet deformation, the visibility of a human may be added at the time of evaluation of the degree of sheet deformation. The print sample means a printed article. Specifically, the shape profiles shown in FIGS. 8A and 8B are subjected to Fourier transform and are decomposed into intensities corresponding to frequencies; intensities are obtained after a filter (low-pass filter) to which the visibility of a human is added is hung; and the obtained intensities can be employed as the amount of sheet deformation. The print sample means a printed article.

Example 4

Of course, an index in which (Example 1) to (Example 3) exemplified above are appropriately combined may also be employed. Further, it goes without saying that an increase in the number of times of measurement is effective to improve the accuracy of data.

[Example of Amount of Sheet Deformation at Each Position]

Figure 13:
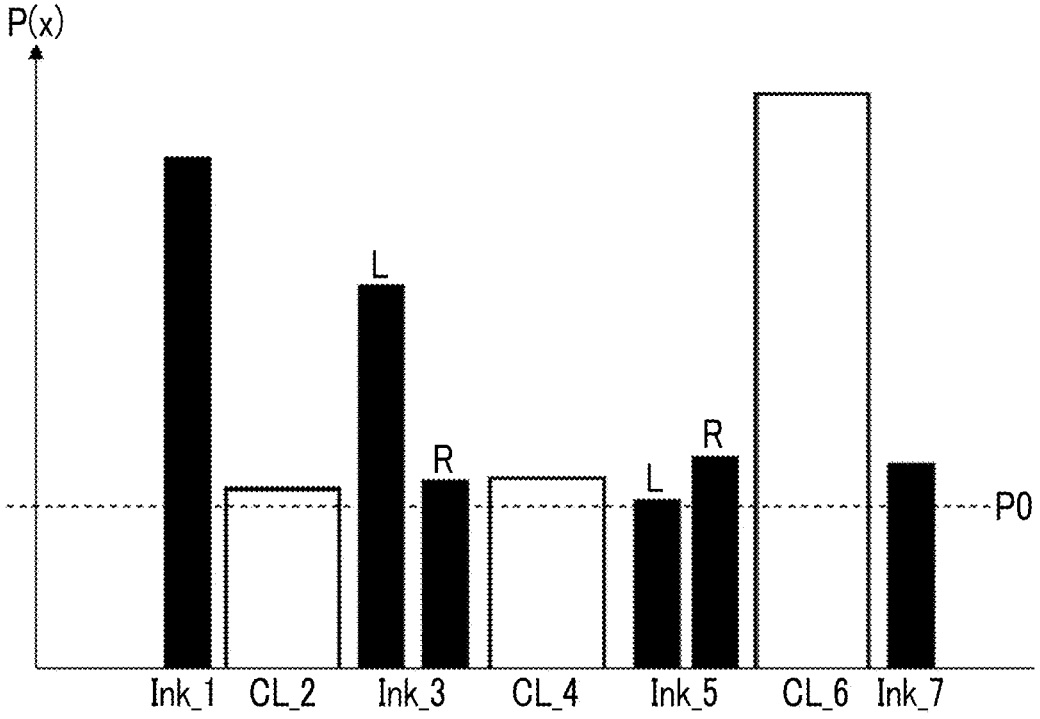
FIG. 13 is a view showing an example of the amount of sheet deformation at each position shown in FIG. 11.

FIG. 13 is a view showing an example of the amount of sheet deformation at each position shown in FIG. 11. A horizontal axis in FIG. 13 represents a position on a sheet in the X direction, and a vertical axis in FIG. 13 represents the amount of sheet deformation. The amount of sheet deformation at a position x on a sheet is written as P(x). For example, the amount of sheet deformation at the position of Ink_1 is written as P(Ink_1). P0 shown in FIG. 13 is a threshold of the amount of sheet deformation that is used as a prescribed value serving as a criterion for correction-necessity determination in the correction-necessity determining step (Step S14 of FIG. 2). P0 of this embodiment is determined as a value that represents the upper limit of the amount of sheet deformation to be allowable. For example, the amount of sheet deformation of a sheet on which nothing is printed is measured, and an average value of the values thereof can be defined as P0.

In a case in which the reading of the degree of sheet deformation is manually performed, an operator reads the degree of sheet deformation at each position by visual observation or tactile sensation, ranks the read degree of sheet deformation according to a predetermined criterion, and obtains data representing contents similar to FIG. 13.

[Correction-Necessity Determining Step]

The correction-necessity determining step (Step S14 of FIG. 6) is a step of determining whether or not to correct the amount of transparent liquid to be jetted by comparing the amount of sheet deformation, which represents the degree of sheet deformation obtained by Step S12, with a prescribed value that is predetermined. P0 described in FIG. 13 can be employed as the prescribed value. If the amount of sheet deformation is equal to or smaller than the prescribed value, it is determined that correction is not needed, the determination of YES is made in Step S14, and the processing of FIG. 2 ends.

If the amount of sheet deformation exceeds the prescribed value in Step S14, it is determined that the correction of the amount of transparent liquid to be jetted is needed and the processing proceeds to the correction coefficient calculating step (Step S16).

[Correction Coefficient Calculating Step]

The correction coefficient calculating step (Step S16 of FIG. 6) is a step of obtaining a correction coefficient that is used to adjust the amount of transparent liquid to be jetted to each transparent liquid application region to an appropriate amount from the data of the amount of sheet deformation obtained in Step S14.

An example of the calculation of a correction coefficient will be specifically described using the data of the amount of sheet deformation shown in FIG. 13 as an example. The amount of transparent liquid in a transparent liquid application region of a position denoted by CL_j is corrected from the amounts of sheet deformation at the respective positions described in the following [1] and [2]. Subscript "j" is a reference numeral that distinguishes a position, and "j" represents an integer in the range of 1 to 7 in the example of FIG. 13.

[1] The amount of sheet deformation at CL_j. That is, P(CL_j).

[2] The amount of sheet deformation in each of the ink application regions that are positioned on the left and right of the position denoted by CL_j. That is, P(Ink_j−1R) that is the amount of sheet deformation at a position "Ink_j−1R" present on the left of CL_j, and P(Ink_j+1L) that is the amount of sheet deformation at a position "Ink_j+1L" present on the right of CL_j.

In this case, CL_j is a region as a target, and Ink_j−1R and Ink_j+1L are ink application regions that are positioned on both sides of CL_1 so as to be adjacent to CL_1.

In regard to [1], the fact that the value of "P(CL_j)−P0" is large means that the transparent liquid application region extends, that is, transparent liquid is excessively jetted. Accordingly, in a case in which the value of "P(CL_j)−P0" is set to ΔP(CL_j), correcting for reducing the amount of transparent liquid to be jetted at CL_j as much as ΔP(CL_j) is large is performed.

In regard to [2], the fact that the value of "P(Ink_j−1R)−P0" or the value of "P(Ink_j+1L)−P0" is large means that the ink application region extends, that is, the jet of transparent liquid is insufficient. Accordingly, in a case in which the value of "P(Ink_j−1R)−P0" is set to ΔP(Ink_j−1R) and the value of "P(Ink_j+1L)−P0" is set to ΔP(Ink_j+1L), correcting for increasing the amount of transparent liquid to be jetted at CL_j as much as the value of ΔP(Ink_j−1R) or ΔP(Ink_j+1L) is large is performed.

Considering the example of FIG. 11, the value of [1] is not a problem at CL_2. That is, the value of the amount P(CL_2) of sheet deformation at the position CL_2 is in a normal range. However, the value of [2] is large. That is, the value of ΔP(Ink_1R) and the value of ΔP(Ink_3L) are large and the amount of jetted transparent liquid is insufficient.

Both the value of [1] and the value of [2] are not a problem at CL_4. That is, the value of ΔP(CL_4) at the position CL_4 is in a normal range, and each of the value of ΔP(Ink_3R) and the value of ΔP(Ink_5 L) is also in a normal range.

The value of [2] is not a problem at CL_6, but the value of [1] is large at CL_6. That is, each of the value of ΔP(Ink_5R) and the value of ΔP(Ink_7 L) is in a normal range. However, the value of ΔP(CL_6) is large and the amount of jetted transparent liquid is too large.

[Specific Example of Correction Coefficient]

An example of a method of calculating each of a first correction coefficient α1 to which [1] is added and a second correction coefficient α2 to which [2] is added will be described below. A method of calculating each of the correction coefficients is not limited to the following example.

$$\alpha 1 = \frac{1}{\Delta P(\mathrm{CL_j}) + 1} \qquad \text{Equation (1)}$$

$$\alpha 2 = \frac{-1}{\frac{\Delta P(\mathrm{Ink_j} - 1R) + \Delta P(\mathrm{Ink_j} + 1L)}{2} + 1} + 2 \qquad \text{Equation (2)}$$

In a case in which the amount of transparent liquid to be jetted is corrected, values, which are obtained by multiplying the current amount of transparent liquid to be jetted by α1 and α2 obtained above, are employed as a new amount of transparent liquid to be jetted. That is, values obtained by multiplying the amount of transparent liquid to be jetted, which is not yet corrected, (that is, the current amount of transparent liquid to be jetted) by α1 and α2 obtained above are the corrected amount of transparent liquid to be jetted. The values of the corrected amount of transparent liquid to be jetted are applied as correction values.

Modification Example

The following method can also be used instead of the above-mentioned calculation of the correction coefficients. That is, k kinds of printing of which the amounts of transparent liquid to be jetted are different from each other are performed; a case in which the amount of sheet deformation in the ink application region is smallest and a case in which the amount of sheet deformation in the transparent liquid application region is smallest are obtained; and the value of the smallest amount of sheet deformation in the ink application region and the value of the smallest amount of sheet deformation in the transparent liquid application region are applied as correction values. k is an integer equal to or larger than 2. k kinds of printing of which the amounts of transparent liquid to be jetted are different from each other mean the output of k kinds of test patterns of which the levels of the amount of transparent liquid to be jetted are set to Lv_1, Lv_2, . . . , Lv_k.

Here, a method of obtaining the amount of transparent liquid to be jetted at the position CL_j will be described using a case in which k is 5 as an example with reference to FIGS. 14 and 15.

Figure 14:
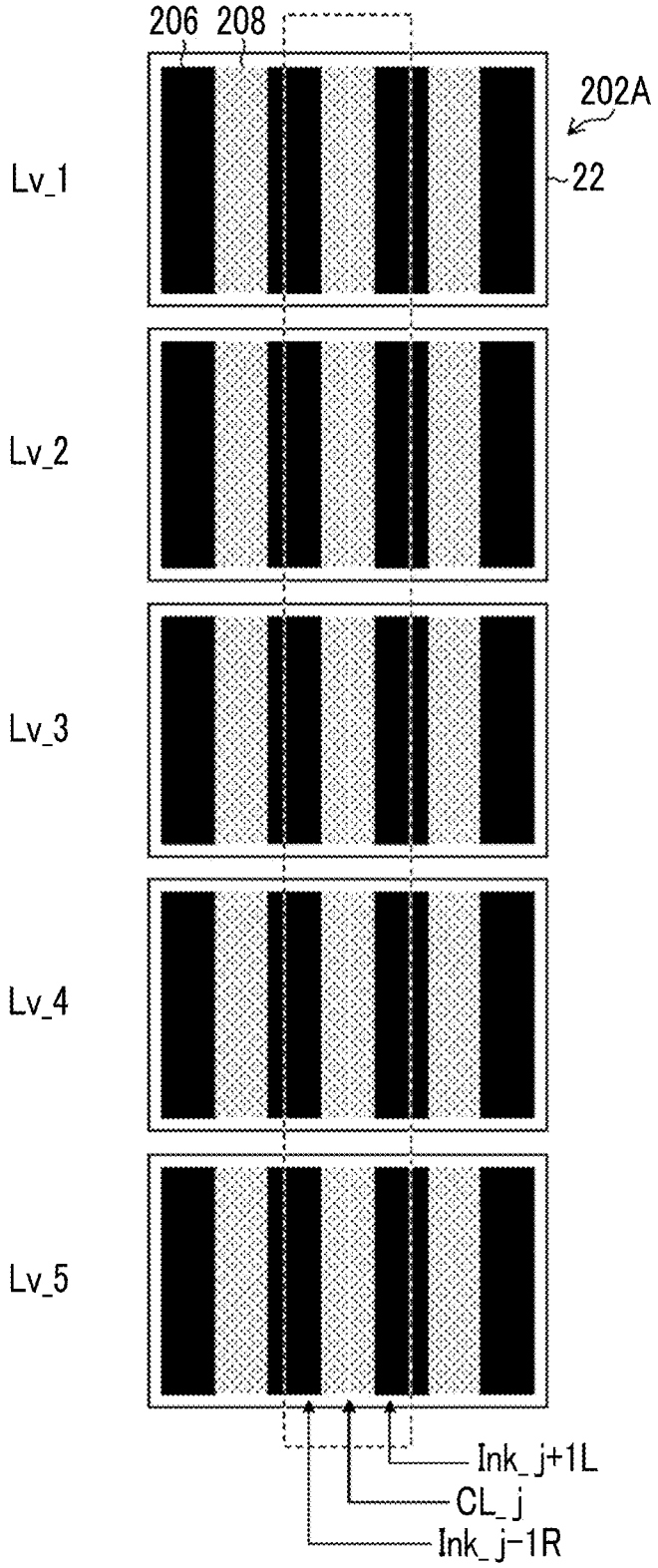
FIG. 14 is a view showing an example in which five kinds of test patterns of which the levels of the amount of transparent liquid to be jetted are different from each other are printed.

FIG. 14 is a view showing an example in which five kinds of test patterns of which the levels of the amount of transparent liquid to be jetted are different from each other are printed. The level of the amount of transparent liquid to be jetted is increased in the order of Lv_1, Lv_2, . . . , Lv_5.

The amount of sheet deformation at each position of each test pattern is measured in the same manner as the example described in FIG. 13.

Figure 15:
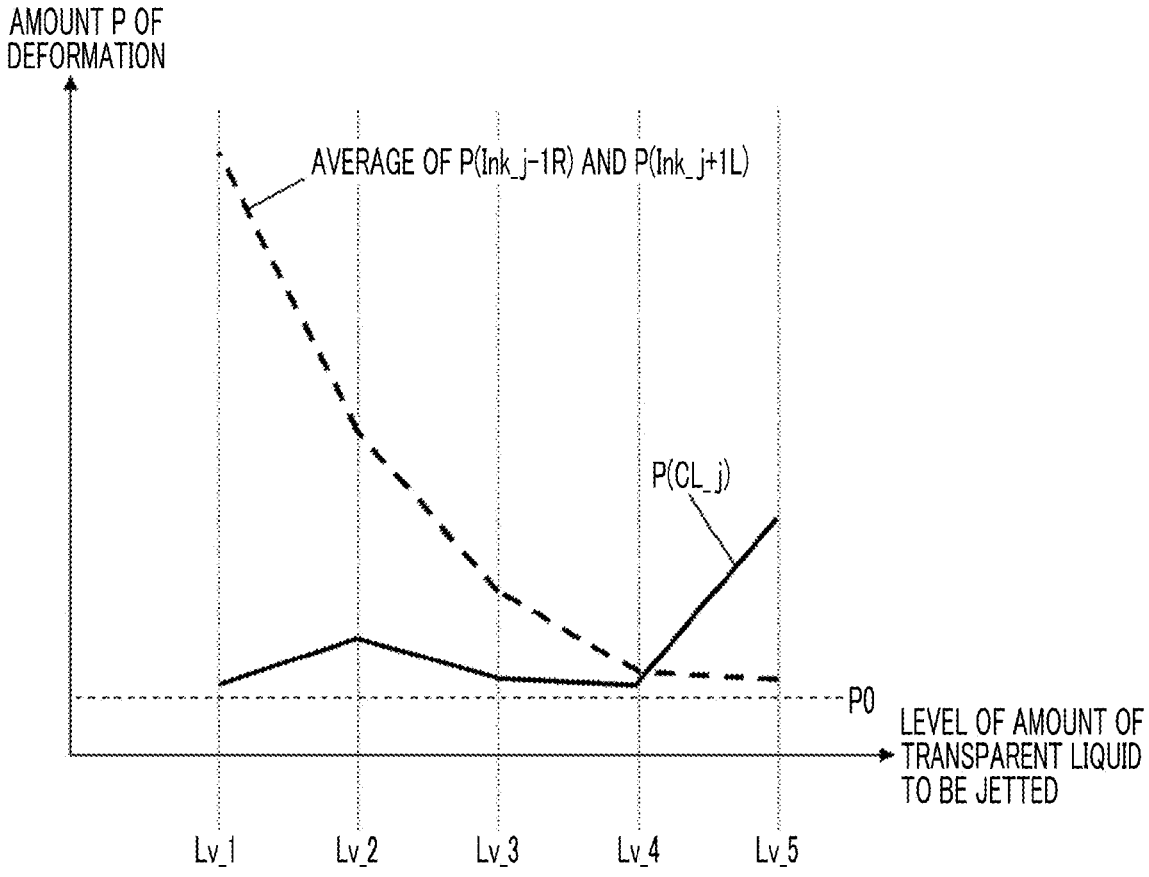
FIG. 15 is a graph showing the amount of sheet deformation with respect to each of the levels of the amount of transparent liquid to be jetted at a specific position.

FIG. 15 is a graph showing the amount of sheet deformation with respect to each of the levels of the amount of transparent liquid to be jetted at a position j. A graph line, which is shown by a thick solid line of FIG. 15, represents P(CL_j) and a graph line, which is shown by a thick broken line, represents an average value of P(Ink_j−1R) and P(Ink_j+1L).

As already described, the amount of sheet deformation in the ink application region is large in a case in which the amount of transparent liquid to be jetted is small and the amount of sheet deformation in the transparent liquid application region is large in a case in which the amount of transparent liquid to be jetted is large. In the case of the example of FIG. 15, it is understood that Lv_4 is optimum at CL_j.

Of course, in a case in which an optimum point is present between the levels of the transparent liquid used to print a test pattern, the value of the optimum point may be obtained by an interpolation operation and may be employed as a correction value. Further, an operator may determine the optimum point from a test pattern and may employ the value of the optimum point as a correction value.

Furthermore, an average value of the amounts of sheet deformation in ink application regions, which are positioned on the left and right of CL_j, is used in FIG. 15. However, the average value of this embodiment does not need to be necessarily used, and the optimum level of the amount of transparent liquid to be jetted may be obtained by using the amounts of sheet deformation in the left and right ink application regions as they are.

The number of test patterns to be printed initially is increased in the above-mentioned modification example but the above-mentioned modification example has an advantage of quick convergence of data in comparison with methods of calculating correction coefficients, such as the above-mentioned Equation (1) and Equation (2).

[Correction Value Introducing Step]

The correction value introducing step (Step S18) shown in FIG. 6 is a step of correcting the amount of transparent liquid to be jetted by introducing the correction value that is obtained in Step S16. That is, the amount of transparent liquid to be jetted is corrected using the correction value and an appropriate amount of transparent liquid to be jetted is determined.

A combination of the correction coefficient calculating step (Step S16) and the correction value introducing step (Step S18) corresponds to one form of an "information processing step".

Specifically, the correction of the amount of transparent liquid to be jetted of this embodiment is performed through the correction of a transparent-liquid-jet-amount-determination table.

The transparent-liquid-jet-amount-determination table is a table in which a correspondence relationship between the total amount of ink to be jetted to a unit region and the amount of transparent liquid to be applied to the unit region is prescribed. The unit region is a region having the minimum unit area that controls the amount of transparent liquid to be applied, and means a region having an area of, for example, about 10 square millimeters on a sheet. The size of the unit region can be set to an appropriate size. The unit region is grasped as a pixel region on image data.

The transparent-liquid-jet-amount-determination table may have the form of a lookup table and may have the form of an arithmetic expression using a function.

Figure 16:
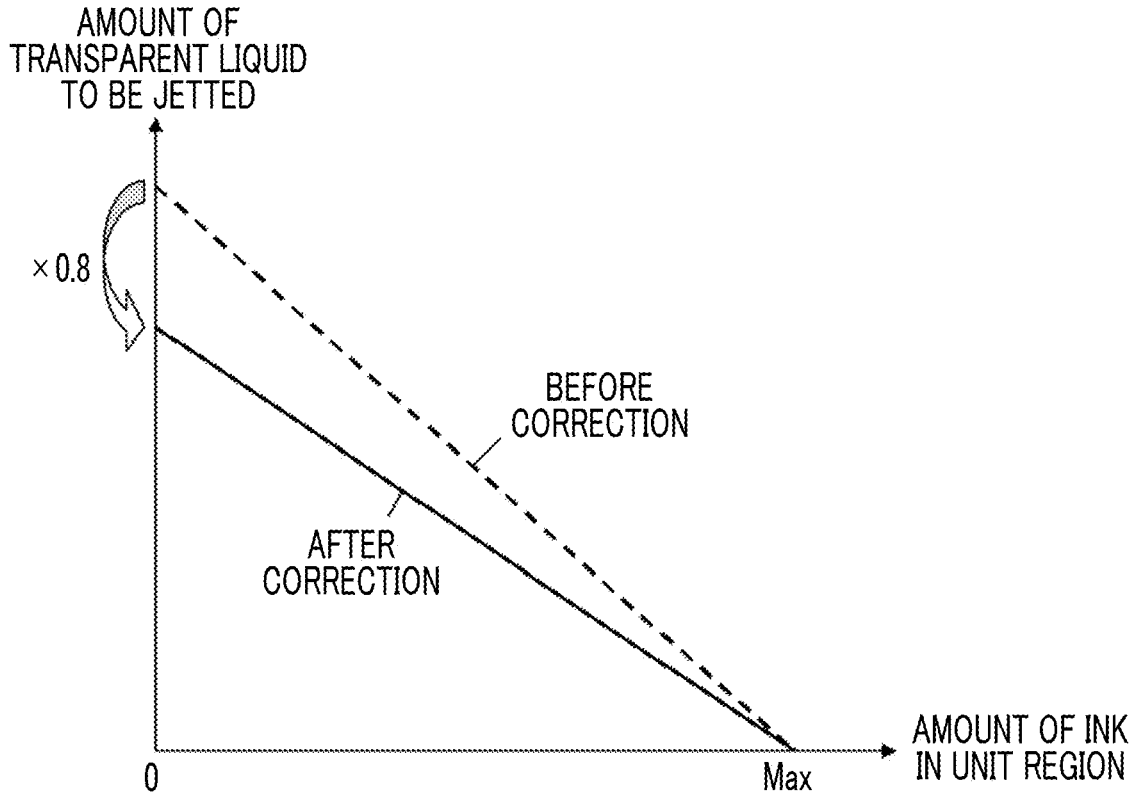
FIG. 16 is a view showing an example of a transparent-liquid-jet-amount-determination table.

FIG. 16 is a view showing an example of the transparent-liquid-jet-amount-determination table. A horizontal axis in FIG. 16 represents the total amount of ink to be jetted to a unit region. In FIG. 16, "the amount of ink of a unit region" is written on the horizontal axis. Written "Max" represents the maximum total amount of ink that can be output from the ink jet printing apparatus, and means the maximum value of the total amount of four color inks of CMYK that can be applied to a unit region in the example of FIG. 1. A vertical axis in FIG. 16 represents the amount of transparent liquid to be applied to a unit region.

In FIG. 16, a graph shown by a broken line represents a transparent-liquid-jet-amount-determination table that is not yet corrected, and a graph shown by a solid line represents a corrected transparent-liquid-jet-amount-determination table.

The value of the amount of transparent liquid to be jetted in the case of "the amount of ink in a unit region is 0" of the transparent-liquid-jet-amount-determination table, which is not yet corrected, is changed according to the correction value obtained in the correction coefficient calculating step (Step S16) of FIG. 6, so that the gradient of the entire graph is changed and the transparent-liquid-jet-amount-determination table is changed. Accordingly, the corrected transparent-liquid-jet-amount-determination table is obtained. FIG. 16 shows an example in which the correction coefficient corresponds to "0.8 times". A corrected value obtained by multiplying the value of the amount of transparent liquid to be jetted, which is not yet corrected, in the case of "the amount of ink in a unit region is 0" by the correction coefficient corresponds to the correction value. The fact that the amount of ink in a unit region is "0" corresponds to the fact that color ink is not applied, that is, a non-image region.

Figure 17:
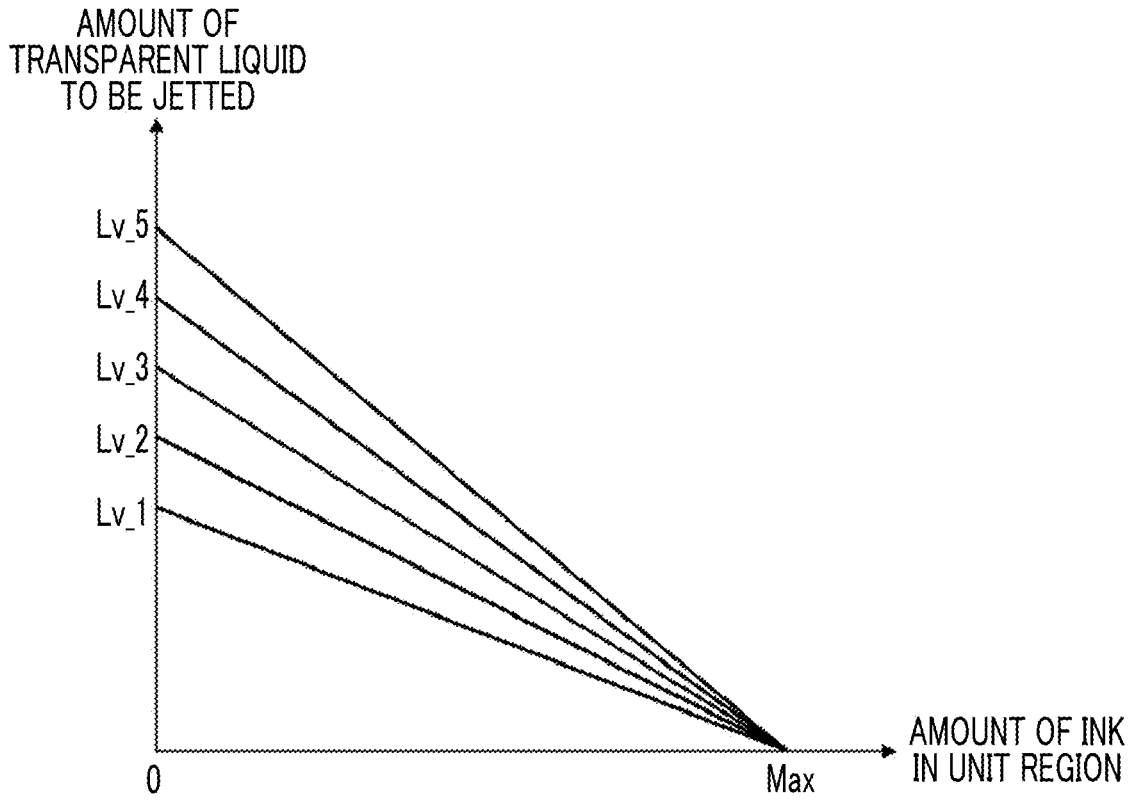
FIG. 17 is a view showing another example of the transparent-liquid-jet-amount-determination table.

FIG. 17 is a view showing an example of the transparent-liquid-jet-amount-determination table in a case to which the method described in the above-mentioned [modification example] is applied.

A transparent-liquid-jet-amount-determination table of the optimum level of the amount of transparent liquid to be jetted is employed from five kinds of different transparent-liquid-jet-amount-determination tables from Lv_1 to Lv_5 by the method described in FIGS. 14 and 15. In the example of FIG. 15, the transparent-liquid-jet-amount-determination table of Lv_4 is employed from the table shown in FIG. 17.

The transparent-liquid-jet-amount-determination table shown in FIG. 16 or 17 is determined for each of the positions j of the transparent liquid application regions 208 of the test pattern. For example, in a case in which the test patterns 202A and 202B described in FIG. 7 are used, the position j of the transparent liquid application region 208 is divided into seven blocks (j=0 to 6). Accordingly, a transparent-liquid-jet-amount-determination table TB(j) is determined for each position j.

[As for Shape of Graph of Transparent-Liquid-Jet-Amount-Determination Table]

All of the graphs of the transparent-liquid-jet-amount-determination tables illustrated in FIGS. 16 and 17 are shown as straight lines in which the amount of transparent liquid is 0 at a value where "the amount of ink in a unit region is Max". However, the shapes of the graphs of the transparent-liquid-jet-amount-determination table are not limited to the straight lines illustrated in FIGS. 16 and 17, and the graphs do not need to be necessarily "straight lines".

Figure 18:
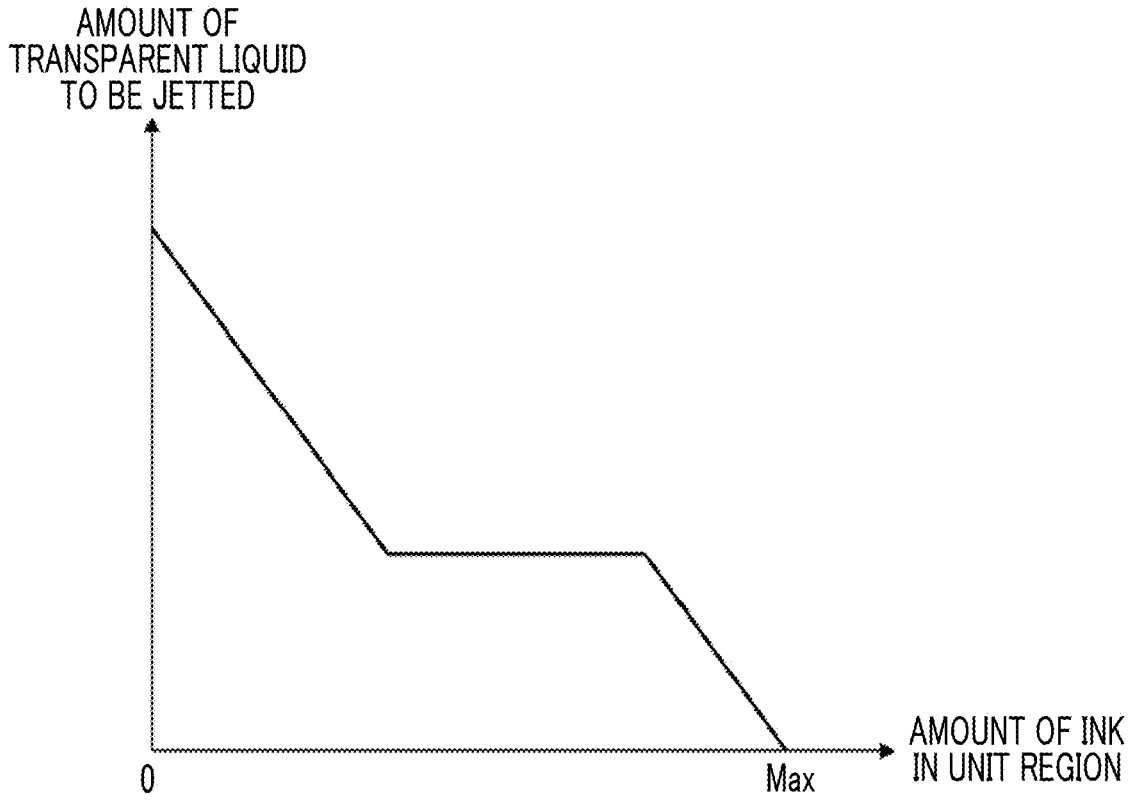
FIG. 18 is a view showing still another example of the transparent-liquid-jet-amount-determination table.

For example, a plateau may be formed in the middle of the graph as shown in FIG. 18, and the amount of transparent liquid also does not need to be "0" at a value where "the amount of ink in a unit region is Max". The "plateau" is a section in which the amount of transparent liquid is constant without depending on the amount of ink. A certain amount of transparent liquid is jetted in the range of the plateau without depending on the amount of ink.

Figure 19:
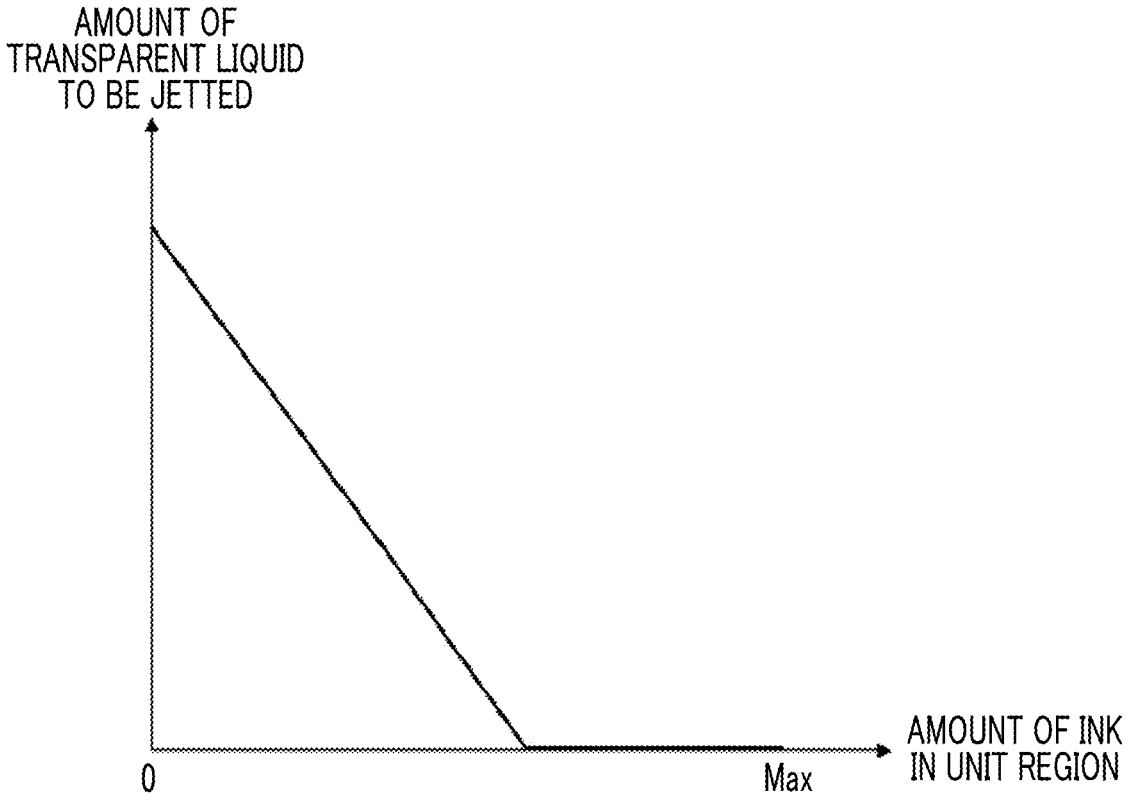
FIG. 19 is a view showing yet another example of the transparent-liquid-jet-amount-determination table.

Further, as shown in FIG. 19, the amount of transparent liquid may be "0" at a value where the amount of ink in a unit region is smaller than "Max".

The transparent-liquid-jet-amount-determination table has only to show a tendency in which the amount of transparent liquid is reduced with an increase in the amount of ink, and is allowed to include a portion where the amount of transparent liquid is constant with an increase in the amount of ink.

[As for Timing at which Processing for Correcting the Amount of Transparent Liquid to be Jetted is Performed]

A timing at which the correction processing of the flow chart described in FIG. 6 is performed is not particularly limited, and can be performed, for example, at the following timing.

(1) The flow chart of FIG. 6 can be performed at the time of work for adjusting setup in a case in which the transparent liquid jet head 72CL is mounted on the ink jet printing apparatus 1.

(2) The processing illustrated in the flow chart of FIG. 6 can be performed in a case in which calibration as a preparation step to be performed before the start of printing performed by the ink jet printing apparatus 1 is performed. The calibration is performed as work to be performed once or plural times a day in, for example, a printing company that provides a printing service.

(3) The flow chart of FIG. 6 can be performed in a case in which the kind of a sheet used for printing is changed. The interaction of color ink with a sheet is different from the interaction of transparent liquid with a sheet, and the optimum amount of color ink and the optimum amount of transparent liquid vary according to the kind of a sheet. Accordingly, it is preferable that processing for correcting the amount of transparent liquid to be jetted is performed in a case in which the kind of a sheet, particularly, the material of a sheet is changed.

[Processing for Determining the Amount of Transparent Liquid to be Jetted at the Time of the Formation of an Image]

Figure 20:
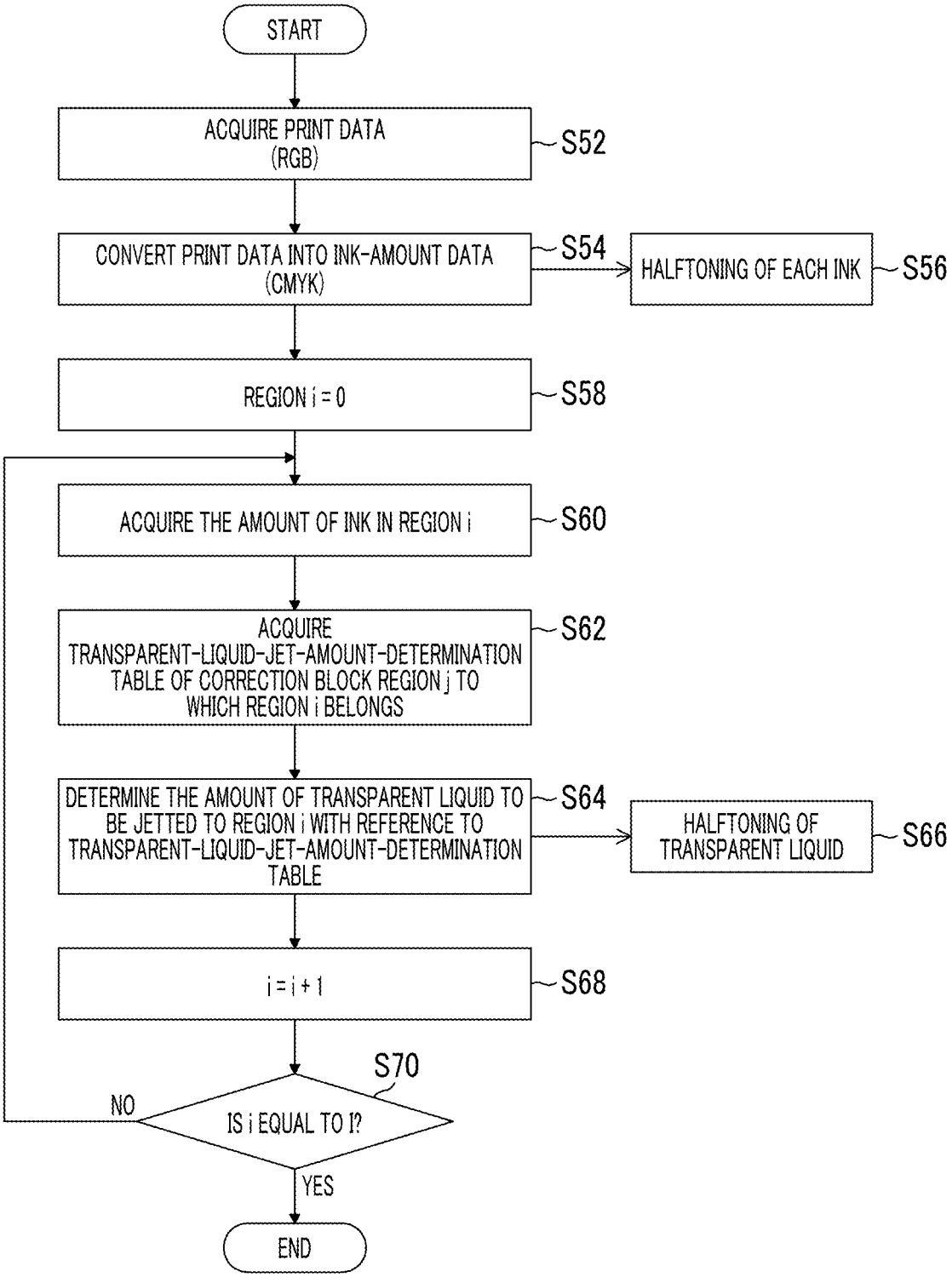
FIG. 20 is a flow chart of processing for determining the amount of transparent liquid to be jetted at the time of printing based on print data.

Next, the flow of processing for determining the amount of transparent liquid to be jetted at the time of actual printing based on print data will be described. FIG. 20 is a flow chart of processing for determining the amount of transparent liquid to be jetted at the time of printing based on print data. The flow chart of FIG. 20 is performed according to the command of a system controller that controls the operation of the ink jet printing apparatus 1.

First, print data including the data of an image as an object to be printed is acquired in a print data acquisition step (Step S52). The format of the print data is not particularly limited, and 24-bit color image data in which each of RGB colors, that is, red (R), green (G), and blue (B) is 8 bits is acquired.

Next, the processing proceeds to an ink-amount data conversion step (Step S54), and processing for converting print data into ink-amount data is performed. The ink-amount data conversion step (Step S54) of this embodiment includes a color conversion step of converting RGB-image data into CMYK-ink-amount data as image data that represents the amount of ink having the respective colors of CMYK. The CMYK-ink-amount data, which is generated in the ink-amount data conversion step (Step S54), is sent to the halftoning of each ink (Step S56) for each color of CMYK and is converted into dot data corresponding to each color.

On the other hand, in Step S58, a region of "i=0", which is an initial value, is designated as a target region of the CMYK-ink-amount data generated in the ink-amount data conversion step (Step S54), that is, CMYK-image data. Here, "i" is an index that represents the position of each of image regions divided so as to have the size of a unit region.

Figure 21:
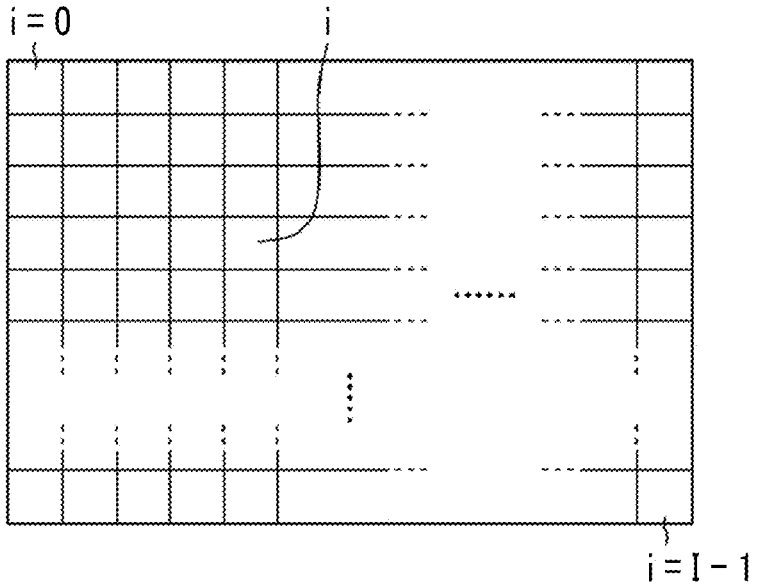
FIG. 21 is a conceptual diagram of a case in which an image as ink-amount data is divided into regions having the size of a unit region.

FIG. 21 is a conceptual diagram of a case in which an image as CMYK-ink-amount data is divided into regions having the size of a unit region. Each of cells shown as a grid of FIG. 21 has the size of a unit region having an area of, for example, about 10 square millimeters. In a case in which the entire image of ink-amount data is divided into I regions, i as an index representing the position of each region is an integer in the range of 0 to "I−1". I represents the total number of the divided regions, and is an integer equal to or larger than 2. It is possible to change the position of a target region by sequentially changing i in the range of 0 to "I−1". The region, which corresponds to the position represented by i serving as an index, is written as "region i".

An example in which an image is divided into I regions is shown in FIG. 21, but an arithmetic method of changing a target region by sequentially moving a window having the size of a unit region may be employed instead of processing for dividing an image. The "window" corresponds to a window function that prescribes a region of a specific number of pixels that is spotlighted as an object to be subjected to arithmetic processing in an image.

Next, the processing proceeds to Step S60 of FIG. 20 and the amount of ink in a region i as a target region is acquired. Since the amount of ink in the region i can be grasped from CMYK-ink-amount data, information about the total amount of inks of CMYK in the region i is acquired.

After that, a transparent-liquid-jet-amount-determination table of a correction block region j of transparent liquid, which belongs to a region i, is acquired (Step S62). Here, j is an index that represents the position of a correction block region, and corresponds to the position j described in FIG. 9. That is, the correction block region j is a region corresponding to the position j of the transparent liquid application region 208.

Figure 22:
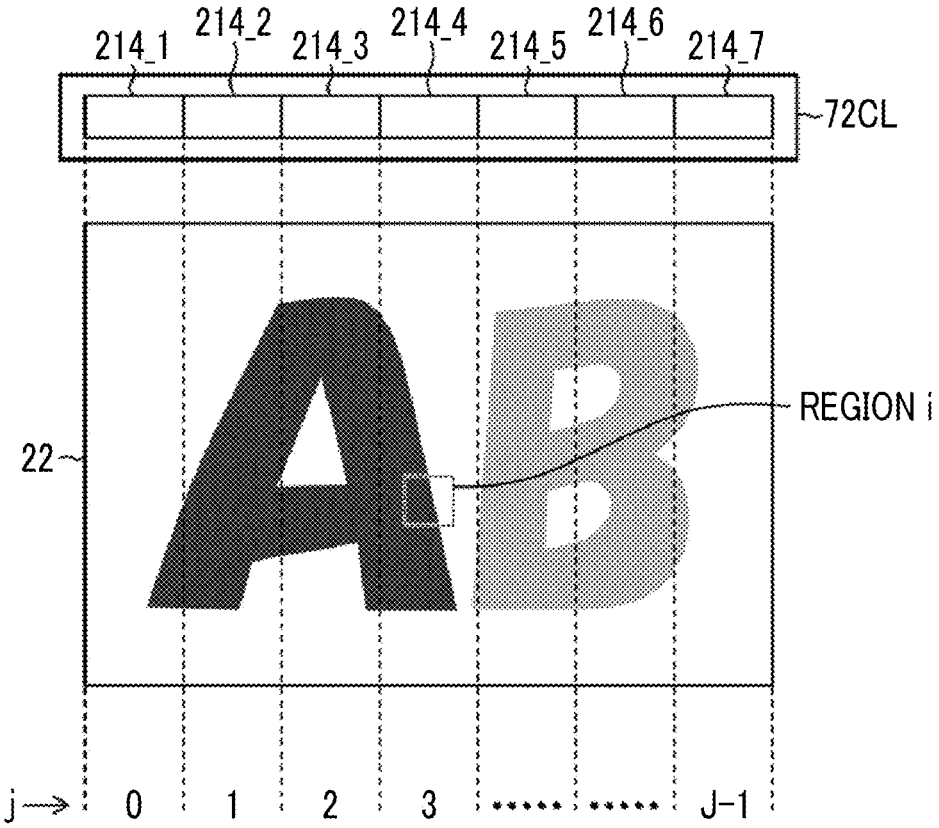
FIG. 22 is a view showing processing for determining the amount of transparent liquid to be applied to a target region of an image as an object to be printed.

FIG. 22 is a view showing processing for determining the amount of transparent liquid to be applied to a target region of an image as an object to be printed. In FIG. 22, the range of a nozzle array of the transparent liquid jet head 72CL in the X direction is divided into seven regions so as to correspond to the lengths of the nozzle arrays of the head modules 214_*r* in the X direction. Further, as in the example described in FIG. 9, in FIG. 22, the range of the nozzle array of the transparent liquid jet head 72CL is divided into seven regions (correction block regions j) so as to correspond to the respective head modules 214_*r*. In a case in which J represents an integer equal to or larger than 2 and the total number of correction block regions j is J, FIG. 22 corresponds to an example of "J=7". The correction block regions j are arranged side by side in the order of "j=0, 1, . . . , J−1" from left in FIG. 22.

A correction block region to which a region i as a target region belongs is a region of "j=3" in the example shown in FIG. 22. A transparent-liquid-jet-amount-determination table of a correction block region of "j=3" is acquired in a case in which the amount of transparent liquid to be jetted to the region i shown in FIG. 22 is to be determined.

After Step S62 of FIG. 20, the processing proceeds to Step S64 and the amount of transparent liquid to be jetted to the region i is determined with reference to the transparent-liquid-jet-amount-determination table acquired in Step S62.

After the amount of transparent liquid to be jetted to the region i is determined, information about the determined amount of transparent liquid is sent to the halftoning of transparent liquid (Step S66) and is converted into dot data that is used to jet transparent liquid. Transparent liquid is jetted by the transparent liquid jet head 72CL on the basis of the dot data of transparent liquid.

In the case of the position of the region i shown in FIG. 22, color ink and transparent liquid are jetted so as to be superimposed in the region i.

After Step S64 of FIG. 20, the processing proceeds to Step S68 and i serving as an index, which represents the position of a target region, is increased to "i+1".

Next, it is determined whether or not i becomes I (Step S70). If i is not I, the processing proceeds to Step S60 and the processing between Step S60 and Step S68 is repeated. In this way, the amount of transparent liquid to be jetted corresponding to the amount of ink in each of all regions i of the image is determined.

If it is confirmed in Step S70 that i becomes I, the flow chart of FIG. 20 ends.

As described above, the image of print data as an object to be printed is divided into regions having the size of a unit region, and the amount of transparent liquid to be jetted to each region is determined from the total amount of ink to be jetted to each region i by using a transparent-liquid-jet-amount-determination table. Further, transparent liquid is jetted according to the determined amount of transparent liquid to be jetted.

Ink is jetted from the recording head 72CMYK according to the dot data that is generated by the halftoning of Step S56 described in FIG. 20 and transparent liquid is jetted from the transparent liquid jet head 72CL according to the dot data that is generated by the halftoning of Step S66, so that printing is performed. This printing step corresponds to one form of an image forming step.

[As for Control System of Ink Jet Printing Apparatus 1]

Figure 23:
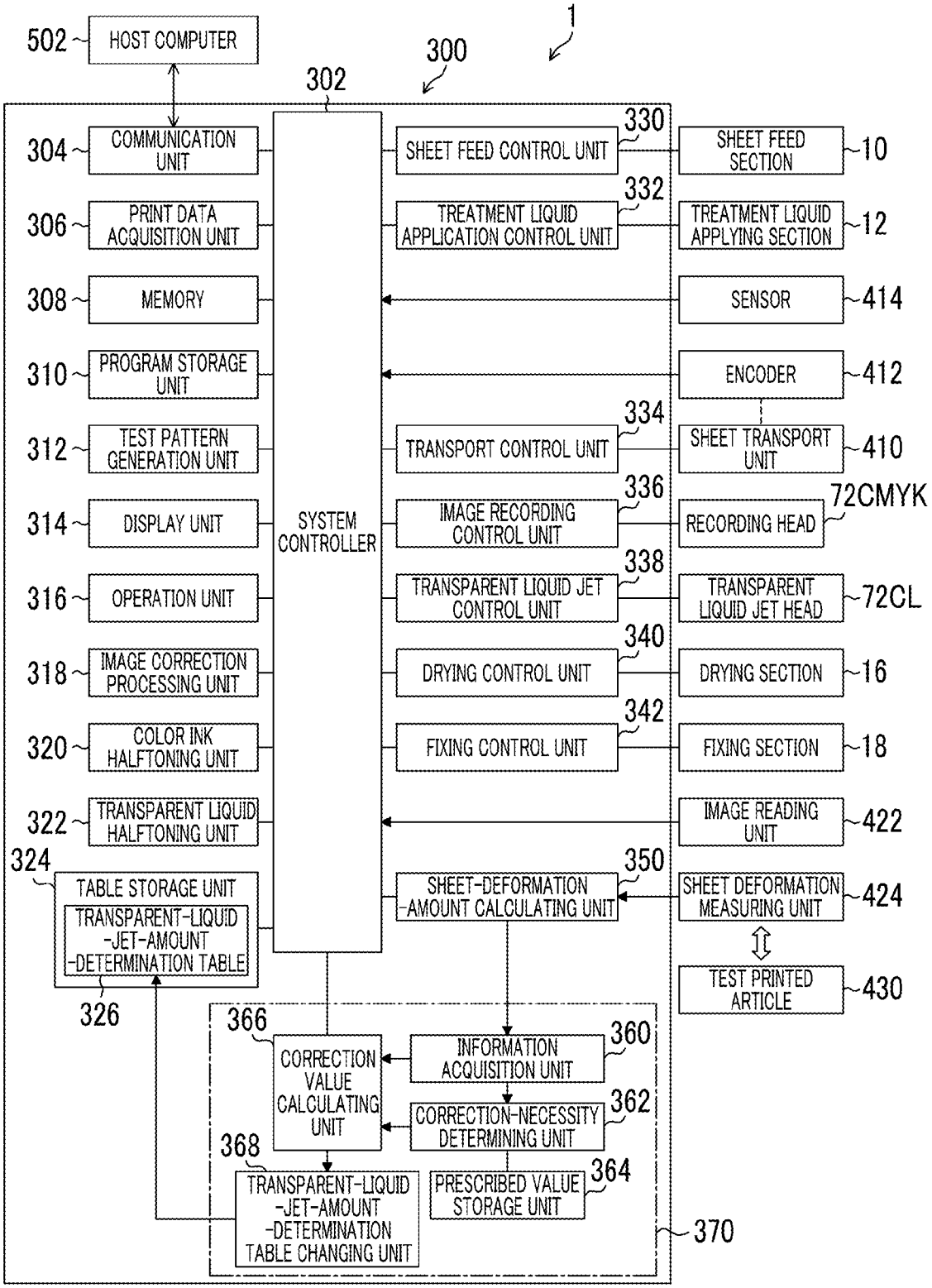
FIG. 23 is a block diagram showing the configuration of a control system of the ink jet printing apparatus 1.

FIG. 23 is a block diagram showing the configuration of a control system of the ink jet printing apparatus 1. Components shown in FIG. 23 corresponding to the components described in FIG. 1 are denoted by the same reference numerals as the reference numerals shown in FIG. 1, and the description thereof will be omitted.

As shown in FIG. 23, the ink jet printing apparatus 1 is controlled by a control device 300. The control device 300 is implemented by hardware and software of a computer. Software is synonymous with "program". The control device 300 includes a system controller 302, a communication unit 304, a print data acquisition unit 306, a memory 308, a program storage unit 310, a test pattern generation unit 312, a display unit 314, and an operation unit 316.

The system controller 302 functions as control means for generally controlling the respective sections of the ink jet printing apparatus 1, and functions as arithmetic means for performing various kinds of arithmetic processing. The system controller 302 includes a central processing unit (CPU), peripheral circuits thereof, and the like; and is operated according to a control program.

A control program to be executed by the system controller 302 and various kinds of data required for control are stored in the program storage unit 310.

The communication unit 304 includes a necessary communication interface. The control device 300 is connected to a host computer 502 through the communication unit 304, and can send and receive data to and from the host computer 502. "Connection", which is mentioned here, includes wired connection, wireless connection, and a combination thereof. A buffer memory, which is used to speed up communication, may be mounted on the communication unit 304.

The print data acquisition unit 306 is an interface unit that acquires print data representing an image as an object to be printed. The data format of the print data is not particularly limited. In this embodiment, an RGB image in which each of RGB colors is 8 bits (256 gradations) is used as the print data. However, the print data is not limited to an RGB image and a CMYK image and the like may be used as the print data. Further, the number of gradations (the number of bits) of a signal is also not limited to this embodiment.

The print data acquisition unit 306 can be formed of a data input terminal to which an image is input from other signal processors provided outside the device or provided in the device. A wired or wireless communication interface unit, a medium interface unit for reading a portable external storage medium, such as a memory card, or an appropriate combination thereof may be employed as the print data acquisition unit 306. The communication unit 304 can serve as the print data acquisition unit 306.

The memory 308 functions as temporary storage means for various kinds of data including print data input from the print data acquisition unit 306.

The test pattern generation unit 312 generates the data of the test patterns described in FIGS. 7, 8A, and 8B. The test pattern generation unit 312 may be adapted to store the data of a predetermined test pattern, and may be adapted to adaptively generate the data of a test pattern.

The display unit 314 and the operation unit 316 form a user interface. Various kinds of input units, such as a keyboard, a mouse, a touch panel, and a trackball, can be employed as the operation unit 316, and appropriate combinations thereof may be employed as the operation unit 316. The display unit 314 and the operation unit 316 may be integrally formed as in a structure in which a touch panel is disposed on the screen of the display unit 314.

An operator can perform the input of various kinds of information, such as the input of printing conditions, the selection of an image quality mode, the input/editing of additional information, and the search of information, by the operation unit 316 while seeing contents displayed on the screen of the display unit 314. Further, an operator can confirm various kinds of information in addition to input contents through the display of the display unit 314.

The control device 300 includes an image correction processing unit 318, a color ink halftoning unit 320, a transparent liquid halftoning unit 322, and a table storage unit 324.

The image correction processing unit 318 performs various kinds of processing for converting or correcting the print data. The processing for converting the print data includes the conversion of the number of pixels, the conversion of gradations, the conversion of colors, and the like. Correction processing includes the correction of density according to the characteristics of the recording head 72CMYK, non jet correction for suppressing the visibility of an image defect caused by a non-jet nozzle, and the like.

The color ink halftoning unit 320 performs halftoning for converting image data of the respective colors of CMYK, which corresponds to ink-amount data of the respective colors of CMYK, into binary or multi-valued dot image data. Publicly known methods, such as a dither method and an error diffusion method, can be used as a halftoning method. Halftoning is processing for converting m-value (m is an integer equal to or larger than 3) multi-gradation image data into n-value (n is an integer equal to or larger than 2 and smaller than m) data, which can be recorded by a recording head, by quantizing the m-value multi-gradation image data. In a case in which the recording head 72CMYK of the ink jet printing apparatus 1 can eject droplets having three kinds of droplet sizes (dot sizes), that is, small droplets, medium droplets, and large droplets, the color ink halftoning unit 320 converts multi-gradation (for example, 256-gradation) print division image data of each color into 4-value (n=4) signals "jetting large droplets", "jetting medium droplets", "jetting small droplets", and "not jetting droplets (no droplet)". Large dots are formed on a sheet 22 by the jet of large droplets, medium dots are formed by the jet of medium droplets, and small dots are formed by the jet of small droplets.

The transparent liquid halftoning unit 322 performs halftoning for converting the image data of transparent liquid, which corresponds to transparent-liquid-jet-amount data representing the amount of transparent liquid to be jetted to each region i (i=0, 1, 2 . . . , I−1) described in FIG. 21, to binary or multi-valued dot image data.

The transparent liquid halftoning unit 322 and the color ink halftoning unit 320 may employ the same halftone algorithm, and may employ different halftone algorithms.

The table storage unit 324 is storage means for storing a transparent-liquid-jet-amount-determination table 326. The transparent-liquid-jet-amount-determination table 326 is determined for each correction block region j as described in FIGS. 20 and 21.

The control device 300 includes a sheet feed control unit 330, a treatment liquid application control unit 332, a transport control unit 334, an image recording control unit 336, a transparent liquid jet control unit 338, a drying control unit 340, and a fixing control unit 342.

The sheet feed control unit 330 controls a sheet feed operation of the sheet feed section 10 according to a command sent from the system controller 302.

The treatment liquid application control unit 332 controls the drive of the respective parts (the treatment liquid applying device 56 and the like described in FIG. 1) of the treatment liquid applying section 12 according to a command sent from the system controller 302.

The transport control unit 334 controls the drive of the respective parts of a sheet transport unit 410 according to a command sent from the system controller 302. The sheet transport unit 410 includes the treatment liquid drum 54, the drawing drum 70, the drying drum 78, the fixing drum 84, the chain transport section 96, the first delivery cylinder 52, the second delivery cylinder 30, the third delivery cylinder 32, and the fourth delivery cylinder 34 that have been described in FIG. 1. The sheet transport unit 410 further includes a motor (not shown) as a power source and a drive unit, such as a motor drive circuit.

The ink jet printing apparatus 1 includes an encoder 412, and various sensors 414. The encoder 412 is provided on the drawing drum 70 (see FIG. 1) of the sheet transport unit 410. A jet trigger signal (pixel trigger) is generated on the basis of a detection signal of the encoder 412. The jet timing of each of the recording head 72CMYK and the transparent liquid jet head 72CL is synchronized with the detection signal of the encoder 412. Accordingly, a landing position can be determined with high accuracy.

The sensors 414 include a sheet detection sensor, a temperature sensor, a humidity sensor, a pressure sensor, and the like (not shown) in addition to the sheet floating sensor 74 shown in FIG. 1. The system controller 302 performs necessary control on the basis of information obtained from the sensors 414.

The image recording control unit 336 controls the drive of the recording head 72CMYK according to a command sent from the system controller 302. A control for outputting a test pattern is performed by the combination of the test pattern generation unit 312, the system controller 302, and the image recording control unit 336. The combination of the test pattern generation unit 312, the system controller 302, and the image recording control unit 336 corresponds to one form of "test pattern printing control means".

The transparent liquid jet control unit 338 controls the drive of the transparent liquid jet head 72CL according to a command sent from the system controller 302.

The drying control unit 340 controls a drying processing operation of the drying section 16 according to a command sent from the system controller 302.

The fixing control unit 342 controls the drive of the first and second fixing rollers 86 and 88 of the fixing section 18 according to a command sent from the system controller 302.

The ink jet printing apparatus 1 includes an image reading unit 422 and a sheet deformation measuring unit 424. The image reading unit 422 and the sheet deformation measuring unit 424 of this embodiment are included in the in-line sensor unit 90 described in FIG. 1. The CCD line sensor, which is mounted on the detection unit of the in-line sensor unit 90, corresponds to the image reading unit 422, and the laser displacement meter corresponds to the sheet deformation measuring unit 424.

The data of the read image, which is acquired by the image reading unit 422, is sent to the image correction processing unit 318 and is used in an arithmetic operation for correcting an image.

The sheet deformation measuring unit 424 measures the irregularity of the recording surface of a test printed article 430 on which a test chart described in the drawings is printed. The sheet deformation measuring unit 424 corresponds to one form of "deformation measurement means".

The control device 300 includes a sheet-deformation-amount calculating unit 350, an information acquisition unit 360, a correction-necessity determining unit 362, a prescribed value storage unit 364, a correction value calculating unit 366, and a transparent-liquid-jet-amount-determination table changing unit 368.

The sheet-deformation-amount calculating unit 350 performs an arithmetic operation for calculating the amount of sheet deformation as information, which represents the degree of sheet deformation, on the basis of measurement data obtained from the sheet deformation measuring unit 424. The sheet-deformation-amount calculating unit 350 calculates the value of the amount of sheet deformation according to predetermined specific indexes, which are exemplified in (Examples 1) to (Example 4) on the basis of, for example, the shape profile described in FIG. 12. The amount of sheet deformation corresponds to one form of "the amount of medium deformation". The unit of the sheet deformation measuring unit 424 may also have the function of the sheet-deformation-amount calculating unit 350.

The information acquisition unit 360 is an interface unit that acquires information about the amount of sheet deformation. The information acquisition unit 360 corresponds to one form of "information acquisition means", and a step of acquiring information by the information acquisition unit 360 corresponds to one form of the "information acquisition step". In the case of this embodiment, the information acquisition unit 360 can acquire information about the amount of sheet deformation that is generated by the sheet-deformation-amount calculating unit 350 provided in the control device 300. In this case, it can be thought that the sheet-deformation-amount calculating unit 350 serves as the information acquisition unit 360 and it can be thought that the sheet-deformation-amount calculating unit 350 and the information acquisition unit 360 are integrated with each other.

Further, the information acquisition unit 360 can acquire information about the amount of sheet deformation that is generated by an external device (for example, a separate computer (not shown)) of the control device 300. Furthermore, the information acquisition unit 360 can acquire information about the amount of sheet deformation that is manually read by an operator.

In a case in which the sheet-deformation-amount calculating unit 350 is mounted on the control device 300, it can be thought that the sheet-deformation-amount calculating unit 350 serves as the information acquisition unit 360 and the sheet-deformation-amount calculating unit 350 and the information acquisition unit 360 can also be integrated with each other. Further, the combination of the sheet deformation measuring unit 424 and the sheet-deformation-amount calculating unit 350 can also be understood as information acquisition means.

The correction-necessity determining unit 362 determines whether or not the amount of transparent liquid to be jetted needs to be corrected on the basis of the amount of sheet deformation.

The prescribed value storage unit 364 is storage means for storing a prescribed value that is used as a threshold serving as a criterion for the determination of the correction-necessity determining unit 362.

The correction value calculating unit 366 performs an arithmetic operation for calculating a correction value of the amount of transparent liquid to be jetted in a case in which the correction-necessity determining unit 362 determines that the amount of transparent liquid to be jetted needs to be corrected. The correction value calculating unit 366 can perform processing for calculating the correction coefficient described in Step S16 of FIG. 6. The correction value calculating unit 366 corresponds to one form of "correction value calculating means".

The transparent-liquid-jet-amount-determination table changing unit 368 performs processing for changing the transparent-liquid-jet-amount-determination table 326 through the application of the correction value that is obtained by the correction value calculating unit 366. The transparent-liquid-jet-amount-determination table changing unit 368 may rewrite and update a table that is not yet corrected and is stored in the table storage unit 324, and may be adapted to add and store a corrected table, which is newly made, in the table storage unit 324. The transparent-liquid-jet-amount-determination table changing unit 368 corresponds to one form of "transparent-liquid-jet-amount-determination table changing means".

In FIG. 23, a functional block, which is surrounded by a one-dot chain line, can be treated as a device 370 for determining the amount of transparent liquid to be jetted. The device 370 for determining the amount of transparent liquid to be jetted shown in FIG. 23 includes the information acquisition unit 360, the correction-necessity determining unit 362, the prescribed value storage unit 364, the correction value calculating unit 366, and the transparent-liquid-jet-amount-determination table changing unit 368. The correction value calculating unit 366 and the transparent-liquid jet-amount-determination table changing unit 368 correspond to one form of "information processing means".

The device 370 for determining the amount of transparent liquid to be jetted can be adapted to include at least one of the sheet-deformation-amount calculating unit 350 and the table storage unit 324. Further, the device 370 for determining the amount of transparent liquid to be jetted can be adapted to include the sheet deformation measuring unit 424 in addition to the sheet-deformation-amount calculating unit 350.

The device 370 for determining the amount of transparent liquid to be jetted of this embodiment is included as a functional block provided in the control device 300, but the control device 300 can be implemented by one or a plurality of computers. Likewise, the function of the device 370 for determining the amount of transparent liquid to be jetted can be implemented by one or a plurality of computers.

The processing for correcting the amount of transparent liquid to be jetted, which has been described in the above-mentioned embodiment, corresponds to one form of a method of determining the amount of transparent liquid to be jetted. A method of obtaining a printed article, which includes a step of recording an image on a sheet 22 by the ink jet printing apparatus 1 and a step of applying transparent liquid, can be grasped as an image forming method.

Other Embodiments

The ink jet printing apparatus 1 using full-line type heads has been described in FIG. 1. However, a range to which the invention is applied is not limited thereto, and the invention can also be applied to an ink jet printing apparatus that records an image by plural numbers of times of scanning using heads while moving short recording heads, such as serial type (shuttle scanning type) heads.

Figure 24:
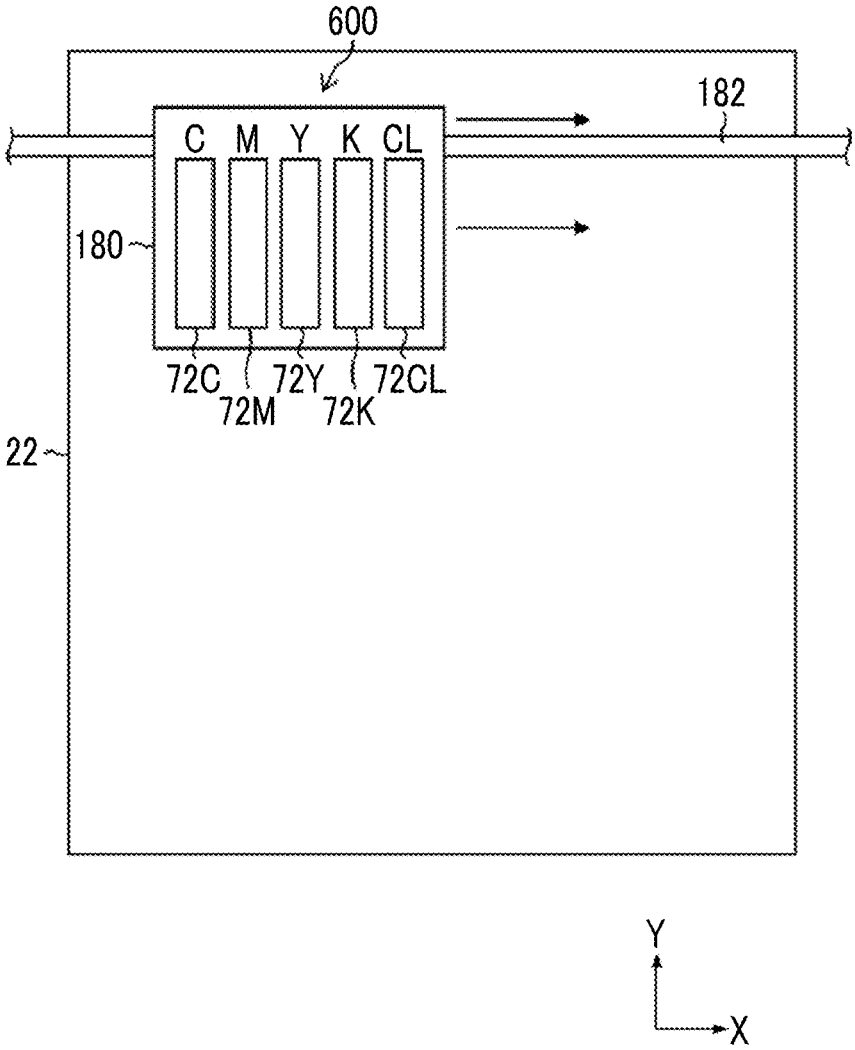
FIG. 24 is a schematic plan view of a drawing section of a serial scan type ink jet printing apparatus according to another embodiment.

FIG. 24 is a schematic plan view of a drawing section of a serial scan type ink jet printing apparatus 600 according to another embodiment. In FIG. 24, components similar to the components described in FIG. 1 are denoted by the same reference numerals as the reference numerals shown in FIG. 1.

Each of recording heads 72C, 72M, 72Y, and 72K corresponding to the respective colors of CMYK and a transparent liquid jet head 72CL, which are shown in FIG. 24, includes nozzle arrays in which nozzles (not shown) are arranged in a Y direction serving as a sheet transport direction. In the case of FIG. 24, a nozzle array direction is the Y direction and a nozzle-array-perpendicular direction is an X direction. Each of the recording heads 72C, 72M, 72Y, and 72K shown in FIG. 24 may be formed of a single head module and may be formed of a combination of a plurality of head modules.

The recording heads 72C, 72M, 72Y, and 72K and the transparent liquid jet head 72CL are mounted on a carriage 180. The carriage 180 is supported by a guide rail 182, and can reciprocate along the guide rail 182 in a direction parallel to the X direction. The sheet 22 is transported in the Y direction by a sheet transport mechanism (not shown).

Figure 25:
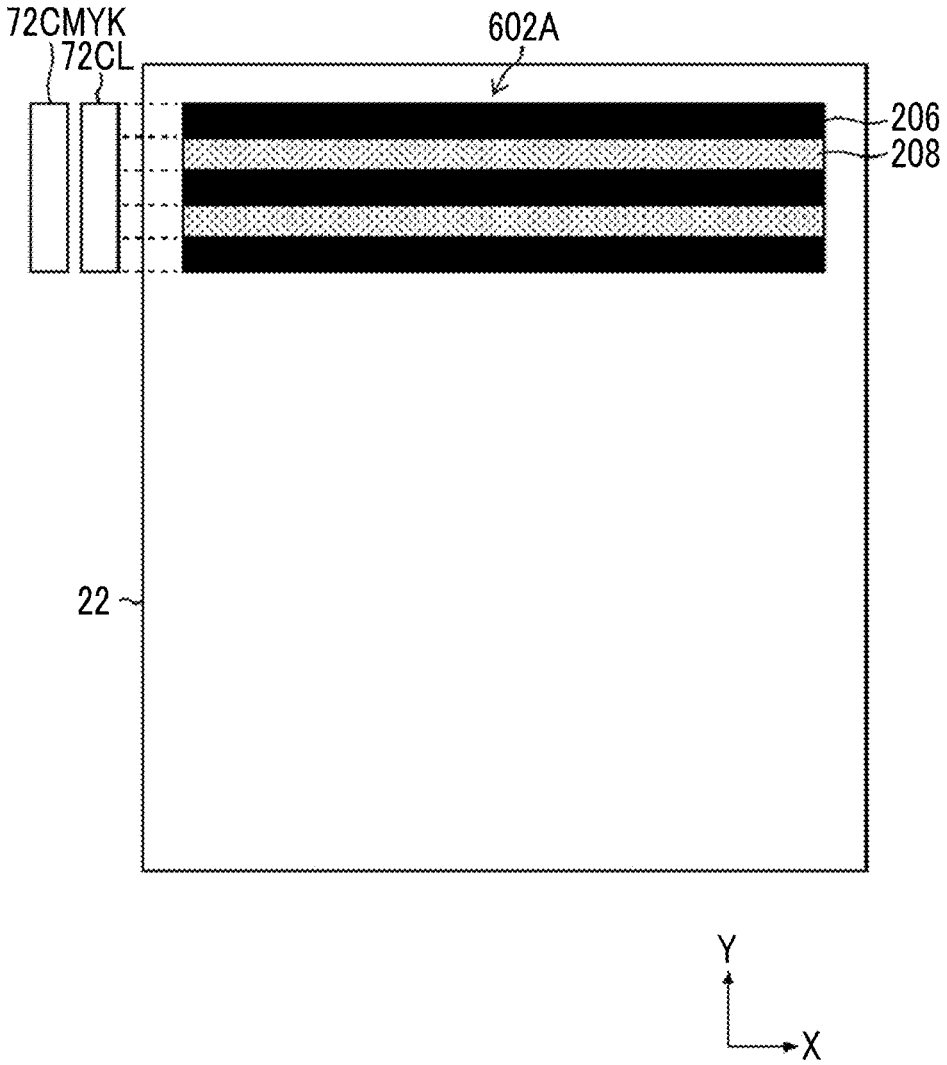
FIG. 25 is a view showing an example of a test pattern that is printed by the ink jet printing apparatus shown in FIG. 24.

In the case of this structure of the apparatus, a test chart, which is used to correct the amount of transparent liquid to be jetted, has a form shown in FIG. 25. In FIG. 25, as in FIG. 7, the recording heads 72C, 72M, 72Y, and 72K shown in FIG. 24 are collectively written as a recording head 72CMYK.

FIG. 25 is a view showing an example of a test pattern that is printed by the ink jet printing apparatus 600 shown in FIG. 24.

A test pattern 602A illustrated in FIG. 25 is formed of a pattern in which stripes extending in the X direction are printed with color ink and transparent liquid is jetted between the plurality of stripes as portions printed with color ink.

An example in which the nozzle arrays of the transparent liquid jet head 72CL are divided into five regions in the Y direction is shown in FIG. 25, but the number of divided nozzle arrays can be an arbitrary numerical value of 2 or more.

Figure 26:
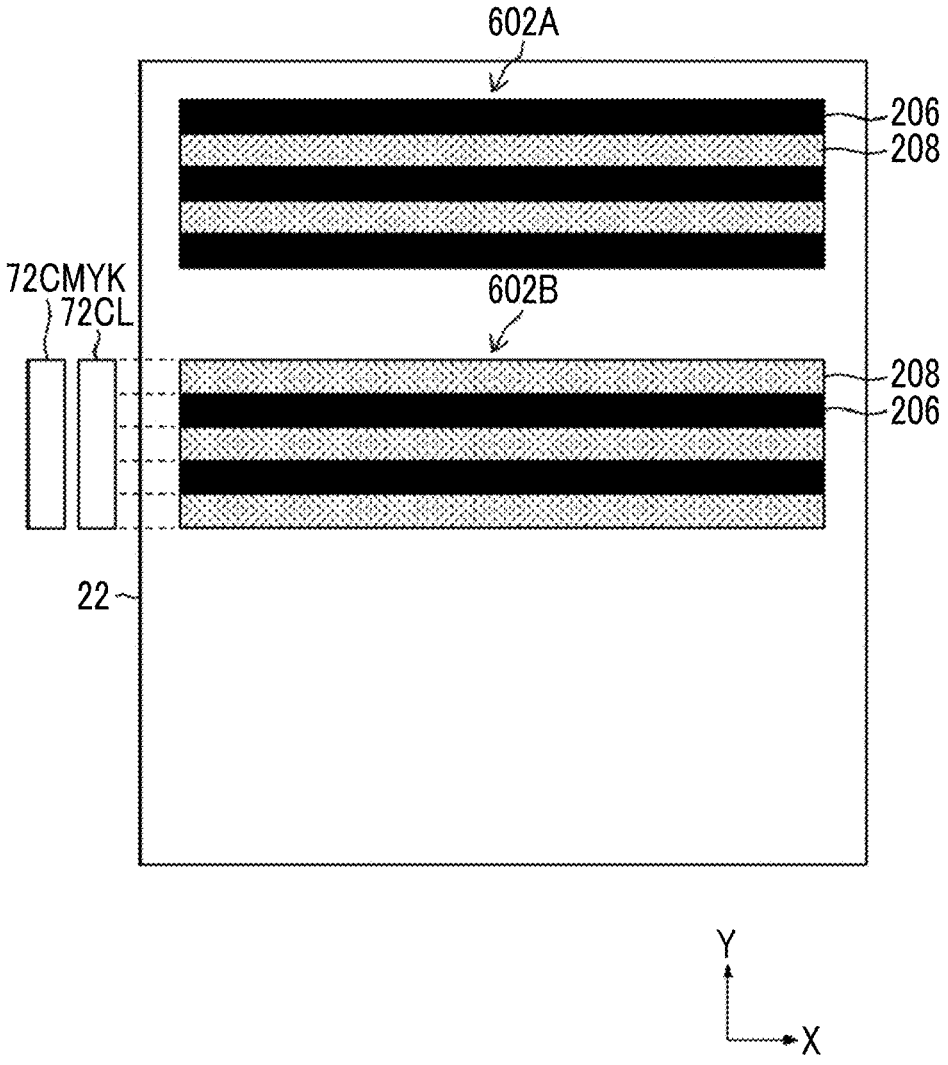
FIG. 26 is a view showing an example of a test pattern that is printed by the ink jet printing apparatus shown in FIG. 24.

After the test pattern 602A shown in FIG. 25 is printed, the sheet 22 is transported in the Y direction to change a recording position on the sheet 22 and a test pattern 602B is printed as shown in FIG. 26. The test pattern 602B is a test pattern in which ink application regions 206 and transparent liquid application regions 208 of the test pattern 602A are replaced with each other.

The degree of sheet deformation is read from the sheet 22 on which the test patterns 602A and 602B are printed. Since a procedure for correcting the amount of transparent liquid to be jetted is the same as that of the example of the already described embodiment, the description thereof will be omitted.

[As for Transparent Liquid]

It is preferable that water and a high-boiling organic solvent of which the solubility parameter (SP) value representing a solubility parameter is higher than the solubility parameter of a high-boiling organic solvent contained in ink are used as a component of the transparent liquid. Accordingly, it is possible to unbend a sheet by applying a smaller amount of transparent liquid to the sheet.

Further, it is preferable that the surface tension of transparent liquid is smaller than the surface tension of ink and the viscosity of transparent liquid is lower than the viscosity of ink. Accordingly, transparent liquid can more quickly permeate into the sheet than ink. As a result, it is possible to unbend the sheet by a smaller amount of transparent liquid.

[As for Transparent Liquid Jet Head]

The resolution of the transparent liquid jet head may be lower than the resolution of the recording head for jetting color ink.

Further, the transparent liquid jet head is not limited to a jet head using an ink jet method, and may be a jet head such as a dispenser.

[As for Sheet Deformation Measurement Means]

The sheet deformation measurement means is not limited to the above-mentioned laser displacement meter. For example, a combination of illumination means for irradiating the recording surface of a sheet 22 with illumination light at a small angle and a camera for imaging the recording surface of the sheet 22 can be used as the sheet deformation measurement means. Shade caused by the irregularity of the surface of the sheet is observed in a case in which the recording surface of the sheet 22 is irradiated with illumination light at a small angle. The shade is imaged by the camera, and the amount of sheet deformation can be grasped from the analysis of an obtained image.

Further, a structure in which the sheet deformation measuring unit 424 is mounted on the detection unit of the in-line sensor unit 90 has been described in the example of FIG. 1, but a form in which the sheet deformation measurement means is installed in the sheet discharge section 20 and a form in which the sheet deformation measurement means is installed on the rear stage of the sheet discharge section 20 can also be employed instead of this structure.

[As for Transport Means for Sheet]

Transport means for transporting a sheet 22 is not limited to a drum transport type illustrated in FIG. 1. Various forms, such as a belt transport type, a nip transport type, a chain transport type, and a pallet transport type can be employed for the transport means, and these types can be appropriately combined.

[As for Medium for Formation of Image]

The term of "medium", which is used for the recording of an image, is a generic term of matters that are called various terms, such as a sheet, a recording sheet, a printing sheet, a printing medium, a print medium, a recording medium, a printing target medium, an image forming medium, an image forming target medium, an image-receiving medium, and a jetting target medium. The material, the shape, and the like of a medium are not particularly limited, and various kinds of sheet materials, such as a continuous sheet, a sheet-like cut paper (a sheet of paper), a seal sheet, a resin sheet, a film, fabric, and non-woven fabric, can be used regardless of other materials and shapes. Since the invention concerns the deformation of a medium after printing, the invention is a particularly useful technique in a case in which the medium is made of a material into which a solvent of ink permeates.

"Image" is interpreted in a broad sense, and also includes a color image, a monochrome image, a single-color image, a gradation image, a uniform density (solid) image, and the like. "Image" is not limited to a photographic image, and is used as a generic term that includes a pattern, a character, a symbol, a line drawing, a mosaic pattern, a painting pattern of color, other various patterns, and an appropriate combination thereof. "Recording of an image" includes the concept of a term, such as the formation, printing, drawing, and the like of an image.

The term of "printing apparatus" is synonymous with terms of a printing machine, a printer, an image recording apparatus, a drawing apparatus, and an image forming apparatus.

[As for Jet Method]

An ejector of an ink jet head, which can used for the recording head and the transparent liquid jet head, includes nozzles that jet liquid, a pressure chamber that communicates with the nozzles, and a jet energy generating element that applies jet energy to liquid present in a pressure chamber. In regard to a jet method of jetting liquid droplets from the nozzles of the ejector, means for generating jet energy is not limited to a piezoelectric element and various jet energy generating elements, such as a heater element and an electrostatic actuator, can be applied as the means for generating jet energy. For example, a method of jetting liquid droplets by using the pressure of film boiling, which is caused when liquid is heated by a heater element, can be employed as the means for generating jet energy. According to the jet method of a liquid jet head, a suitable jet energy generating element is provided in a channel structure.

[As for Means for Moving Recording Head Relative to Sheet]

Since a sheet 22 is transported by the drawing drum 70 in the case of the single-pass ink jet printing apparatus 1 illustrated in FIG. 1, the recording head 72CMYK and sheet 22 are moved relative to each other in the nozzle-array-perpendicular direction. Further, the transparent liquid jet head 72CL and the sheet 22 are moved with respect to each other in the nozzle-array-perpendicular direction. Accordingly, the drawing drum 70 corresponds to one form of relative movement means for moving a sheet 22 relative to the recording head 72CMYK in the nozzle-array-perpendicular direction and moving the sheet 22 relative to the transparent liquid jet head 72CL in the nozzle-array-perpendicular direction.

in the case of the serial type head illustrated in FIG. 24, head scanning means, which includes the carriage 180 used for the scanning using the heads and a mechanism for driving the carriage 180, corresponds to one form of the relative movement means for moving the recording head 72CMYK relative to the sheet 22 in the nozzle-array-perpendicular direction and moving the transparent liquid jet head 72CL relative to the sheet 22 in the nozzle-array-perpendicular direction.

Components can be appropriately modified, added, and removed in above-mentioned embodiments of the invention without departing from the scope of the invention. The invention is not limited to the above-mentioned embodiments, and can be modified in various ways within the technical idea of the invention through the usual knowledge in the art.

EXPLANATION OF REFERENCES

1: ink jet printing apparatus
14: drawing section
22: sheet
70: drawing drum
72C, 72M, 72Y, 72K: recording head
72CL: transparent liquid jet head
72CMYK: recording head
90: in-line sensor unit
112: head module
120: nozzle
180: carriage
202A, 202B, 202C, 202D: test pattern
206: ink application region
208: transparent liquid application region
300: control device
312: test pattern generation unit
324: table storage unit
326: transparent-liquid-jet-amount-determination table
336: image recording control unit
338: transparent liquid jet control unit
360: information acquisition unit
366: correction value calculating unit
368: transparent-liquid-jet-amount-determination table changing unit
370: device for determining the amount of transparent liquid to be jetted
424: sheet deformation measuring unit
430: test printed article
602A, 602B: test pattern

What is claimed is:

1. A device for determining the amount of transparent liquid to be jetted, the device comprising:

information acquisition means for acquiring information representing the amount of medium deformation of a test pattern which is printed by ink jet means for jetting ink containing a color material and transparent liquid jet means for jetting transparent liquid and in which the ink and the transparent liquid are applied to different regions on the same medium and ink application regions to which the ink is applied and transparent liquid application regions to which the transparent liquid is applied are arranged adjacent to each other; and information processing means for determining the amount of transparent liquid to be jetted by the transparent liquid jet means for jetting the transparent liquid, from the information representing the amount of medium deformation acquired by the information acquisition means, wherein the test pattern includes the plurality of ink application regions, and the transparent liquid application regions are disposed between the plurality of ink application regions, the amount of transparent liquid to be jetted to each of the plurality of transparent liquid application regions is determined on the basis of the amount of medium deformation of the transparent liquid application region corresponding to a region as a target and the amount of medium deformation of the ink application regions that are positioned on both sides of the region as a target so as to be adjacent to the region, the information processing means reduces the amount of transparent liquid to be jetted to the region as a target as much as the amount of medium deformation of the transparent liquid application region corresponding to the region as a target is large, and the information processing means increases the amount of transparent liquid to be jetted to the region as a target as much as the amount of medium deformation of the ink application regions, which are positioned on both sides of the region as a target so as to be adjacent to the region, is large.

2. The device for determining the amount of transparent liquid to be jetted according to claim 1, wherein the transparent liquid jet means comprises a nozzle array in which a plurality of nozzles are arranged at different positions in a first direction, the test pattern includes the ink application regions having the shape of a stripe extending in a second direction, which is a direction perpendicular to the first direction of the medium, and the transparent liquid application regions that has the shape of a stripe extending in the second direction, and the transparent liquid application regions and the ink application regions are arranged adjacent to each other in the first direction.

3. The device for determining the amount of transparent liquid to be jetted according to claim 1, wherein each of the ink jet means and the transparent liquid jet means includes a plurality of head modules for jetting liquid droplets by an ink jet method, and each of the stripes of the plurality of transparent liquid application regions to which the transparent liquid is applied is formed by the jet of the transparent liquid from N head modules of the transparent liquid jet means in a case in which N is set to an integer equal to or larger than 1.

4. The device for determining the amount of transparent liquid to be jetted according to claim 1, further comprising:

deformation measurement means for measuring the amount of deformation of a test printed article on which the test pattern is printed, wherein the information acquisition means acquires information representing the amount of medium deformation from the amount of deformation measured by the deformation measurement means.

5. The device for determining the amount of transparent liquid to be jetted according to claim 1, wherein the information processing means includes correction value calculating means for obtaining a correction value, which is used to correct the amount of transparent liquid to be jetted, from the information representing the amount of medium deformation.

6. The device for determining the amount of transparent liquid to be jetted according to claim 1, wherein a plurality of times of test printing in which the amount of transparent liquid to be jetted to the transparent liquid application regions of the test pattern varies are performed, the information acquisition means acquires information representing the amount of medium deformation of each of the plurality of times of test printing, and the information processing means determines a value of the amount of transparent liquid to be jetted, which is obtained when the amount of medium deformation is minimum, as a value of the amount of transparent liquid to be jetted, on the basis of information representing the amount of medium deformation obtained from each of the plurality of times of test printing.

7. The device for determining the amount of transparent liquid to be jetted according to claim 1, wherein the information processing means includes transparent-liquid-jet-amount-determination table changing means for changing a transparent-liquid-jet-amount-determination table in which a relationship between the amount of ink per unit region and the amount of transparent liquid to be jetted is prescribed, by using the determined value of the amount of transparent liquid to be jetted.

8. A method of determining the amount of transparent liquid to be jetted, the method comprising:

an information acquisition step of acquiring information representing the amount of medium deformation of a test pattern which is printed by ink jet means for jetting ink containing a color material and transparent liquid jet means for jetting transparent liquid and in which the ink and the transparent liquid are applied to different regions on the same medium and ink application regions to which the ink is applied and transparent liquid application regions to which the transparent liquid is applied are arranged adjacent to each other; and an information processing step of determining the amount of transparent liquid to be jetted by the transparent liquid jet means for jetting the transparent liquid, from the information representing the amount of medium deformation acquired by the information acquisition step, wherein the test pattern includes the plurality of ink application regions, and the transparent liquid application regions are disposed between the plurality of ink application regions, the amount of transparent liquid to be jetted to each of the plurality of transparent liquid application regions is determined on the basis of the amount of medium deformation of the transparent liquid application region corresponding to a region as a target and the amount of medium deformation of the ink application regions that are positioned on both sides of the region as a target so as to be adjacent to the region, and the information processing step including:

reducing the amount of transparent liquid to be jetted to the region as a target as much as the amount of medium deformation of the transparent liquid application region corresponding to the region as a target is large; and increasing the amount of transparent liquid to be jetted to the region as a target as much as the amount of medium deformation of the ink application regions, which are positioned on both sides of the region as a target so as to be adjacent to the region, is large.

9. The method of determining the amount of transparent liquid to be jetted according to claim 8, further comprising:

a test pattern printing step of printing the test pattern by the ink jet means and the transparent liquid jet means.

10. An image forming apparatus comprising:

ink jet means for jetting ink containing a color material;

transparent liquid jet means for jetting transparent liquid;

test pattern printing control means for outputting a test pattern in which the ink and the transparent liquid are applied to different regions on the same medium and ink application regions to which the ink is applied and transparent liquid application regions to which the transparent liquid is applied are arranged adjacent to each other, by controlling the ink jet means and the transparent liquid jet means;

information acquisition means for acquiring information representing the amount of medium deformation of the test pattern; and information processing means for determining the amount of transparent liquid to be jetted, from the information representing the amount of medium deformation acquired by the information acquisition means, wherein the test pattern includes the plurality of ink application regions, and the transparent liquid application regions are disposed between the plurality of ink application regions, the amount of transparent liquid to be jetted to each of the plurality of transparent liquid application regions is determined on the basis of the amount of medium deformation of the transparent liquid application region corresponding to a region as a target and the amount of medium deformation of the ink application regions that are positioned on both sides of the region as a target so as to be adjacent to the region, the information processing means reduces the amount of transparent liquid to be jetted to the region as a target as much as the amount of medium deformation of the transparent liquid application region corresponding to the region as a target is large, and the information processing means increases the amount of transparent liquid to be jetted to the region as a target as much as the amount of medium deformation of the ink application regions, which are positioned on both sides of the region as a target so as to be adjacent to the region, is large.

11. An image forming method comprising:

a test pattern printing step of printing a test pattern by ink jet means for jetting ink containing a color material and transparent liquid jet means for jetting transparent liquid and in which the ink and the transparent liquid are applied to different regions on the same medium and ink application regions to which the ink is applied and transparent liquid application regions to which the transparent liquid is applied are arranged adjacent to each other;

an information acquisition step of acquiring information representing the amount of medium deformation of the test pattern;

an information processing step of determining the amount of transparent liquid to be jetted by the transparent liquid jet means for jetting the transparent liquid, from the information representing the amount of medium deformation acquired by the information acquisition step; and an image forming step of performing printing by jetting the ink by the ink jet means on the basis of print data and jetting the transparent liquid from the transparent liquid jet means according to the determined amount of transparent liquid to be jetted, wherein the test pattern includes the plurality of ink application regions, and the transparent liquid application regions are disposed between the plurality of ink application regions, the amount of transparent liquid to be jetted to each of the plurality of transparent liquid application regions is determined on the basis of the amount of medium deformation of the transparent liquid application region corresponding to a region as a target and the amount of medium deformation of the ink application regions that are positioned on both sides of the region as a target so as to be adjacent to the region, and the information processing step including:

reducing the amount of transparent liquid to be jetted to the region as a target as much as the amount of medium deformation of the transparent liquid application region corresponding to the region as a target is large; and increasing the amount of transparent liquid to be jetted to the region as a target as much as the amount of medium deformation of the ink application regions, which are positioned on both sides of the region as a target so as to be adjacent to the region, is large.

* * * * *